US010380944B2

(12) United States Patent
Soni et al.

(10) Patent No.: US 10,380,944 B2
(45) **Date of Patent: *Aug. 13, 2019**

(54) STRUCTURAL AND LOW-FREQUENCY NON-UNIFORMITY COMPENSATION

(71) Applicant: Ignis Innovation Inc., Waterloo (CA)

(72) Inventors: Jaimal Soni, Waterloo (CA); Ricky Yik Hei Ngan, Richmond Hills (CA); Gholamreza Chaji, Waterloo (CA); Nino Zahirovic, Waterloo (CA); Joseph Marcel Dionne, Waterloo (CA); Baolin Tian, Kitchener (CA); Allyson Giannikouris, Kitchener (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/112,161

(22) Filed: Aug. 24, 2018

(65) Prior Publication Data

US 2018/0366063 A1 Dec. 20, 2018

Related U.S. Application Data

(63) Continuation of application No. 14/255,132, filed on Apr. 17, 2014, now Pat. No. 10,089,924, which is a (Continued)

(51) Int. Cl.
*G09G 3/3233* (2016.01)

(52) U.S. Cl.
CPC ... *G09G 3/3233* (2013.01); *G09G 2320/0295* (2013.01); *G09G 2320/045* (2013.01); *G09G 2354/00* (2013.01); *G09G 2360/14* (2013.01)

(58) Field of Classification Search
None
See application file for complete search history.

(56) References Cited

U.S. PATENT DOCUMENTS 3,506,851 A 4/1970 Polkinghorn
3,774,055 A 11/1973 Bapat
(Continued)

FOREIGN PATENT DOCUMENTS

CA 1 294 034 1/1992
CA 2 109 951 11/1992
(Continued)

OTHER PUBLICATIONS

Ahnood : "Effect of threshold voltage instability on field effect mobility in thin film transistors deduced from constant current measurements"; dated Aug. 2009.
(Continued)

*Primary Examiner* — Ifedayo B Iluyomade
(74) *Attorney, Agent, or Firm* — Stratford Managers Corporation

(57) ABSTRACT

A system for compensating for non-uniformities in an array of solid state devices in a display panel displays images in the panel, and extracts the outputs of a pattern based on structural non-uniformities of the panel, across the panel, for each area of the structural non-uniformities. Then the structural non-uniformities are quantified, based on the values of the extracted outputs, and input signals to the display panel are modified to compensate for the structural non-uniformities. Random non-uniformities are compensated by extracting low-frequency non-uniformities across the panel by applying patterns, and taking images of the pattern. The area and resolution of the image are adjusted to match the panel by creating values for pixels in the display, and then low-frequency non-uniformities across the panel are compensated, based on the created values.

10 Claims, 10 Drawing Sheets

Related U.S. Application Data continuation-in-part of application No. 14/204,209, filed on Mar. 11, 2014, now Pat. No. 9,324,268, and a continuation-in-part of application No. 13/689,241, filed on Nov. 29, 2012, now Pat. No. 9,385,169.

(60) Provisional application No. 61/787,397, filed on Mar. 15, 2013, provisional application No. 61/564,634, filed on Nov. 29, 2011.

(56) References Cited

U.S. PATENT DOCUMENTS

| | | | |
|---|---|---|---|
| 4,090,096 | A | 5/1978 | Nagami |
| 4,160,934 | A | 7/1979 | Kirsch |
| 4,295,091 | A | 10/1981 | Ponkala |
| 4,354,162 | A | 10/1982 | Wright |
| 4,943,956 | A | 7/1990 | Noro |
| 4,996,523 | A | 2/1991 | Bell |
| 5,153,420 | A | 10/1992 | Hack |
| 5,198,803 | A | 3/1993 | Shie |
| 5,204,661 | A | 4/1993 | Hack |
| 5,266,515 | A | 11/1993 | Robb |
| 5,489,918 | A | 2/1996 | Mosier |
| 5,498,880 | A | 3/1996 | Lee |
| 5,557,342 | A | 9/1996 | Eto |
| 5,561,381 | A | 10/1996 | Jenkins |
| 5,572,444 | A | 11/1996 | Lentz |
| 5,589,847 | A | 12/1996 | Lewis |
| 5,619,033 | A | 4/1997 | Weisfield |
| 5,648,276 | A | 7/1997 | Hara |
| 5,670,973 | A | 9/1997 | Bassetti |
| 5,684,365 | A | 11/1997 | Tang |
| 5,691,783 | A | 11/1997 | Numao |
| 5,714,968 | A | 2/1998 | Ikeda |
| 5,723,950 | A | 3/1998 | Wei |
| 5,744,824 | A | 4/1998 | Kousai |
| 5,745,660 | A | 4/1998 | Kolpatzik |
| 5,748,160 | A | 5/1998 | Shieh |
| 5,815,303 | A | 9/1998 | Berlin |
| 5,870,071 | A | 2/1999 | Kawahata |
| 5,874,803 | A | 2/1999 | Garbuzov |
| 5,880,582 | A | 3/1999 | Sawada |
| 5,903,248 | A | 5/1999 | Irwin |
| 5,917,280 | A | 6/1999 | Burrows |
| 5,923,794 | A | 7/1999 | McGrath |
| 5,945,972 | A | 8/1999 | Okumura |
| 5,949,398 | A | 9/1999 | Kim |
| 5,952,789 | A | 9/1999 | Stewart |
| 5,952,991 | A | 9/1999 | Akiyama |
| 5,982,104 | A | 11/1999 | Sasaki |
| 5,990,629 | A | 11/1999 | Yamada |
| 6,023,259 | A | 2/2000 | Howard |
| 6,069,365 | A | 5/2000 | Chow |
| 6,091,203 | A | 7/2000 | Kawashima |
| 6,097,360 | A | 8/2000 | Holloman |
| 6,144,222 | A | 11/2000 | Ho |
| 6,177,915 | B1 | 1/2001 | Beeteson |
| 6,229,506 | B1 | 5/2001 | Dawson |
| 6,229,508 | B1 | 5/2001 | Kane |
| 6,246,180 | B1 | 6/2001 | Nishigaki |
| 6,252,248 | B1 | 6/2001 | Sano |
| 6,259,424 | B1 | 7/2001 | Kurogane |
| 6,262,589 | B1 | 7/2001 | Tamukai |
| 6,271,825 | B1 | 8/2001 | Greene |
| 6,288,696 | B1 | 9/2001 | Holloman |
| 6,304,039 | B1 | 10/2001 | Appelberg |
| 6,307,322 | B1 | 10/2001 | Dawson |
| 6,310,962 | B1 | 10/2001 | Chung |
| 6,320,325 | B1 | 11/2001 | Cok |
| 6,323,631 | B1 | 11/2001 | Juang |
| 6,329,971 | B2 | 12/2001 | McKnight |
| 6,356,029 | B1 | 3/2002 | Hunter |
| 6,373,454 | B1 | 4/2002 | Knapp |
| 6,377,237 | B1 | 4/2002 | Sojourner |
| 6,392,617 | B1 | 5/2002 | Gleason |
| 6,404,139 | B1 | 6/2002 | Sasaki |
| 6,414,661 | B1 | 7/2002 | Shen |
| 6,417,825 | B1 | 7/2002 | Stewart |
| 6,433,488 | B1 | 8/2002 | Bu |
| 6,437,106 | B1 | 8/2002 | Stoner |
| 6,445,369 | B1 | 9/2002 | Yang |
| 6,475,845 | B2 | 11/2002 | Kimura |
| 6,501,098 | B2 | 12/2002 | Yamazaki |
| 6,501,466 | B1 | 12/2002 | Yamagishi |
| 6,518,962 | B2 | 2/2003 | Kimura |
| 6,522,315 | B2 | 2/2003 | Ozawa |
| 6,525,683 | B1 | 2/2003 | Gu |
| 6,531,827 | B2 | 3/2003 | Kawashima |
| 6,541,921 | B1 | 4/2003 | Luciano, Jr. |
| 6,542,138 | B1 | 4/2003 | Shannon |
| 6,555,420 | B1 | 4/2003 | Yamazaki |
| 6,577,302 | B2 | 6/2003 | Hunter |
| 6,580,408 | B1 | 6/2003 | Bae |
| 6,580,657 | B2 | 6/2003 | Sanford |
| 6,583,398 | B2 | 6/2003 | Harkin |
| 6,583,775 | B1 | 6/2003 | Sekiya |
| 6,594,606 | B2 | 7/2003 | Everitt |
| 6,618,030 | B2 | 9/2003 | Kane |
| 6,639,244 | B1 | 10/2003 | Yamazaki |
| 6,668,645 | B1 | 12/2003 | Gilmour |
| 6,677,713 | B1 | 1/2004 | Sung |
| 6,680,580 | B1 | 1/2004 | Sung |
| 6,687,266 | B1 | 2/2004 | Ma |
| 6,690,000 | B1 | 2/2004 | Muramatsu |
| 6,690,344 | B1 | 2/2004 | Takeuchi |
| 6,693,388 | B2 | 2/2004 | Oomura |
| 6,693,610 | B2 | 2/2004 | Shannon |
| 6,697,057 | B2 | 2/2004 | Koyama |
| 6,720,942 | B2 | 4/2004 | Lee |
| 6,724,151 | B2 | 4/2004 | Yoo |
| 6,734,636 | B2 | 5/2004 | Sanford |
| 6,738,034 | B2 | 5/2004 | Kaneko |
| 6,738,035 | B1 | 5/2004 | Fan |
| 6,753,655 | B2 | 6/2004 | Shih |
| 6,753,834 | B2 | 6/2004 | Mikami |
| 6,756,741 | B2 | 6/2004 | Li |
| 6,756,952 | B1 | 6/2004 | Decaux |
| 6,756,958 | B2 | 6/2004 | Furuhashi |
| 6,756,985 | B1 | 6/2004 | Hirotsune |
| 6,765,549 | B1 | 7/2004 | Yamazaki |
| 6,771,028 | B1 | 8/2004 | Winters |
| 6,777,712 | B2 | 8/2004 | Sanford |
| 6,777,888 | B2 | 8/2004 | Kondo |
| 6,781,306 | B2 | 8/2004 | Park |
| 6,781,567 | B2 | 8/2004 | Kimura |
| 6,806,497 | B2 | 10/2004 | Jo |
| 6,806,638 | B2 | 10/2004 | Lih |
| 6,806,857 | B2 | 10/2004 | Sempel |
| 6,809,706 | B2 | 10/2004 | Shimoda |
| 6,815,975 | B2 | 11/2004 | Nara |
| 6,828,950 | B2 | 12/2004 | Koyama |
| 6,853,371 | B2 | 2/2005 | Miyajima |
| 6,859,193 | B1 | 2/2005 | Yumoto |
| 6,873,117 | B2 | 3/2005 | Ishizuka |
| 6,876,346 | B2 | 4/2005 | Anzai |
| 6,885,356 | B2 | 4/2005 | Hashimoto |
| 6,900,485 | B2 | 5/2005 | Lee |
| 6,903,734 | B2 | 6/2005 | Eu |
| 6,909,243 | B2 | 6/2005 | Inukai |
| 6,909,419 | B2 | 6/2005 | Zavracky |
| 6,911,960 | B1 | 6/2005 | Yokoyama |
| 6,911,964 | B2 | 6/2005 | Lee |
| 6,914,448 | B2 | 7/2005 | Jinno |
| 6,919,871 | B2 | 7/2005 | Kwon |
| 6,924,602 | B2 | 8/2005 | Komiya |
| 6,937,215 | B2 | 8/2005 | Lo |
| 6,937,220 | B2 | 8/2005 | Kitaura |
| 6,940,214 | B1 | 9/2005 | Komiya |
| 6,943,500 | B2 | 9/2005 | LeChevalier |
| 6,943,761 | B2 | 9/2005 | Everitt |
| 6,947,022 | B2 | 9/2005 | McCartney |
| 6,954,194 | B2 | 10/2005 | Matsumoto |
| 6,956,547 | B2 | 10/2005 | Bae |
| 6,975,142 | B2 | 12/2005 | Azami |

(56) References Cited

U.S. PATENT DOCUMENTS 6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,263 B1 6/2006 Ong
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Chang
7,116,058 B2 10/2006 Lo
7,119,493 B2 10/2006 Fryer
7,122,835 B1 10/2006 Ikeda
7,127,380 B1 10/2006 Iverson
7,129,914 B2 10/2006 Knapp
7,129,938 B2 10/2006 Naugler
7,161,566 B2 1/2007 Cok
7,164,417 B2 1/2007 Cok
7,193,589 B2 3/2007 Yoshida
7,199,768 B2 4/2007 Ono
7,224,332 B2 5/2007 Cok
7,227,519 B1 6/2007 Kawase
7,245,277 B2 7/2007 Ishizuka
7,246,912 B2 7/2007 Burger
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,339,560 B2 3/2008 Sun
7,355,574 B1 4/2008 Leon
7,358,941 B2 4/2008 Ono
7,368,868 B2 5/2008 Sakamoto
7,394,195 B2 7/2008 Kato
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,463,222 B2 12/2008 Fish
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,924,249 B2 4/2011 Nathan
7,932,883 B2 4/2011 Klompenhouwer
7,960,917 B2 6/2011 Kimura
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min
8,310,413 B2 11/2012 Fish
8,314,783 B2 11/2012 Sambandan
8,339,386 B2 12/2012 Leon
8,441,206 B2 5/2013 Myers
8,493,296 B2 7/2013 Ogawa
8,581,809 B2 11/2013 Nathan
8,654,114 B2 2/2014 Shimizu
9,125,278 B2 9/2015 Nathan
9,368,063 B2 6/2016 Chaji
9,418,587 B2 8/2016 Chaji
9,430,958 B2 8/2016 Chaji
9,472,139 B2 10/2016 Nathan
9,489,891 B2 11/2016 Nathan
9,489,897 B2 11/2016 Jaffari
9,502,653 B2 11/2016 Chaji
9,530,349 B2 12/2016 Chaji
9,530,352 B2 12/2016 Nathan
9,536,460 B2 1/2017 Chaji
9,536,465 B2 1/2017 Chaji
9,589,490 B2 3/2017 Chaji
9,633,597 B2 4/2017 Nathan
9,640,112 B2 5/2017 Jaffari
9,721,512 B2 8/2017 Soni
9,741,279 B2 8/2017 Chaji
9,741,282 B2 8/2017 Giannikouris
9,761,170 B2 9/2017 Chaji
9,773,439 B2 9/2017 Chaji
9,773,441 B2 9/2017 Chaji
9,786,209 B2 10/2017 Chaji
10,089,924 B2 * 10/2018 Soni ..... G09G 3/3233
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt

(56) References Cited

U.S. PATENT DOCUMENTS

2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr.
2003/0122813 A1 7/2003 Ishizuki
2003/0142088 A1 7/2003 LeChevalier
2003/0146897 A1 8/2003 Hunter
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0036457 A1 2/2004 Tokioka
2004/0036708 A1 2/2004 Evanicky
2004/0041750 A1 3/2004 Abe
2004/0051469 A1 3/2004 Ha
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0178974 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067943 A1 3/2005 Sakaguchi
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0190610 A1 9/2005 Furukawa
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007070 A1 1/2006 Shih
2006/0007072 A1 1/2006 Choi
2006/0007206 A1 1/2006 Reddy
2006/0007249 A1 1/2006 Reddy
2006/0012310 A1 1/2006 Chen
2006/0012311 A1 1/2006 Ogawa
2006/0015272 A1 1/2006 Giraldo
2006/0022204 A1 2/2006 Steer
2006/0022305 A1 2/2006 Yamashita
2006/0022907 A1 2/2006 Uchino
2006/0027807 A1 2/2006 Nathan
2006/0030084 A1 2/2006 Young
2006/0038501 A1 2/2006 Koyama
2006/0038758 A1 2/2006 Routley
2006/0038762 A1 2/2006 Chou
2006/0044227 A1 3/2006 Hadcock
2006/0061248 A1 3/2006 Cok
2006/0063281 A1 3/2006 Cok
2006/0066533 A1 3/2006 Sato
2006/0077134 A1 4/2006 Hector
2006/0077135 A1 4/2006 Cok
2006/0077136 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim
2006/0103611 A1 5/2006 Choi
2006/0125740 A1 6/2006 Shirasaki
2006/0149493 A1 7/2006 Sambandan
2006/0170623 A1 8/2006 Naugler, Jr.

(56) References Cited

U.S. PATENT DOCUMENTS

2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok
2007/0103419 A1 5/2007 Uchino
2007/0115221 A1 5/2007 Buchhauser
2007/0126672 A1 6/2007 Tada
2007/0164664 A1 7/2007 Ludwicki
2007/0164937 A1 7/2007 Jung
2007/0164938 A1 7/2007 Shin
2007/0164959 A1 7/2007 Childs
2007/0182671 A1 8/2007 Nathan
2007/0195020 A1 8/2007 Nathan
2007/0236134 A1 10/2007 Ho
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1 12/2007 Cok
2007/0290958 A1 12/2007 Cok
2007/0296672 A1 12/2007 Kim
2008/0001525 A1 1/2008 Chao
2008/0001544 A1 1/2008 Murakami
2008/0012804 A1 1/2008 Kim
2008/0030518 A1 2/2008 Higgins
2008/0036706 A1 2/2008 Kitazawa
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0122803 A1 5/2008 Izadi
2008/0136770 A1 6/2008 Peker
2008/0150845 A1 6/2008 Ishii
2008/0150847 A1 6/2008 Kim
2008/0158115 A1 7/2008 Cordes
2008/0158648 A1 7/2008 Cummings
2008/0170004 A1 7/2008 Jung
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0225183 A1 9/2008 Tomizawa
2008/0230118 A1 9/2008 Nakatani
2008/0231558 A1 9/2008 Naugler
2008/0231562 A1 9/2008 Kwon
2008/0231625 A1 9/2008 Minami
2008/0246713 A1 10/2008 Lee
2008/0252223 A1 10/2008 Toyoda
2008/0252571 A1 10/2008 Hente
2008/0259020 A1 10/2008 Fisekovic
2008/0284768 A1 11/2008 Yoshida et al.
2008/0290805 A1 11/2008 Yamada
2008/0297055 A1 12/2008 Miyake
2009/0015532 A1 1/2009 Katayama
2009/0033598 A1 2/2009 Suh
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0162961 A1 6/2009 Deane
2009/0174628 A1 7/2009 Wang
2009/0184901 A1 7/2009 Kwon
2009/0195483 A1 8/2009 Naugler, Jr.
2009/0201281 A1 8/2009 Routley
2009/0206764 A1 8/2009 Schemmann
2009/0207160 A1 8/2009 Shirasaki
2009/0213046 A1 8/2009 Nam
2009/0244046 A1 10/2009 Seto
2009/0262047 A1 10/2009 Yamashita
2009/0309503 A1 12/2009 kIM
2010/0004891 A1 1/2010 Ahlers
2010/0026725 A1 2/2010 Smith
2010/0033469 A1 2/2010 Nathan
2010/0039422 A1 2/2010 Seto
2010/0039458 A1 2/2010 Nathan
2010/0045646 A1 2/2010 Kishi
2010/0045650 A1 2/2010 Fish
2010/0060911 A1 3/2010 Marcu
2010/0073335 A1 3/2010 Min
2010/0073357 A1 3/2010 Min
2010/0078230 A1 4/2010 Rosenblatt
2010/0079419 A1 4/2010 Shibusawa
2010/0085282 A1 4/2010 Yu
2010/0103160 A1 4/2010 Jeon
2010/0103203 A1 4/2010 Choi
2010/0134456 A1 6/2010 Oyamada
2010/0134469 A1 6/2010 Ogura
2010/0134475 A1 6/2010 Ogura
2010/0165002 A1 7/2010 Ahn
2010/0188320 A1 7/2010 Min
2010/0194670 A1 8/2010 Cok
2010/0207960 A1 8/2010 Kimpe
2010/0225630 A1 9/2010 Levey
2010/0231528 A1 9/2010 Wolfe
2010/0237374 A1 9/2010 Chu
2010/0251295 A1 9/2010 Amento
2010/0277400 A1 11/2010 Jeong
2010/0315319 A1 12/2010 Cok
2011/0032232 A1 2/2011 Smith
2011/0050870 A1 3/2011 Hanari
2011/0063197 A1 3/2011 Chung
2011/0069051 A1 3/2011 Nakamura
2011/0069089 A1 3/2011 Kopf
2011/0069094 A1 3/2011 Knapp
2011/0069096 A1 3/2011 Li
2011/0074750 A1 3/2011 Leon
2011/0074762 A1 3/2011 Shirasaki
2011/0109610 A1 5/2011 Yamamoto
2011/0149166 A1 6/2011 Botzas
2011/0169798 A1 7/2011 Lee
2011/0175895 A1 7/2011 Hayakawa
2011/0181630 A1 7/2011 Smith
2011/0191042 A1 8/2011 Chaji
2011/0199395 A1 8/2011 Nathan
2011/0227964 A1* 9/2011 Chaji ..... G09G 3/006
345/690

(56) References Cited

U.S. PATENT DOCUMENTS

| | | | | |
|---|---|---|---|---|
| 2011/0242074 | A1 | 10/2011 | Bert | |
| 2011/0273399 | A1 | 11/2011 | Lee | |
| 2011/0279488 | A1 | 11/2011 | Nathan | |
| 2011/0292006 | A1 | 12/2011 | Kim | |
| 2011/0293480 | A1 | 12/2011 | Mueller | |
| 2012/0056558 | A1 | 3/2012 | Toshiya | |
| 2012/0062565 | A1 | 3/2012 | Fuchs | |
| 2012/0262184 | A1 | 10/2012 | Shen | |
| 2012/0299970 | A1 | 11/2012 | Bae | |
| 2012/0299973 | A1 | 11/2012 | Jaffari | |
| 2012/0299978 | A1 | 11/2012 | Chaji | |
| 2013/0002527 | A1 | 1/2013 | Kim | |
| 2013/0027381 | A1 | 1/2013 | Nathan | |
| 2013/0057595 | A1 | 3/2013 | Nathan | |
| 2013/0112960 | A1 | 5/2013 | Chaji | |
| 2013/0135272 | A1 | 5/2013 | Park | |
| 2013/0162617 | A1 | 6/2013 | Yoon | |
| 2013/0201223 | A1 | 8/2013 | Li | |
| 2013/0241813 | A1 | 9/2013 | Tanaka | |
| 2013/0309821 | A1 | 11/2013 | Yoo | |
| 2013/0321671 | A1 | 12/2013 | Cote | |
| 2014/0015824 | A1 | 1/2014 | Chaji | |
| 2014/0022289 | A1 | 1/2014 | Lee | |
| 2014/0043316 | A1 | 2/2014 | Chaji | |
| 2014/0055500 | A1 | 2/2014 | Lai | |
| 2014/0111567 | A1 | 4/2014 | Nathan | |
| 2014/0225938 | A1* | 8/2014 | Soni ..... | G09G 3/3233 345/690 |
| 2015/0366016 | A1 | 12/2015 | Kitamura | |
| 2016/0275860 | A1 | 9/2016 | Wu | |
| 2017/0011674 | A1 | 1/2017 | Chaji | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2526436 | | 2/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1538377 | A | 10/2004 |
| CN | 1623180 | A | 6/2005 |
| CN | 1682267 | A | 10/2005 |
| CN | 1758309 | A | 4/2006 |
| CN | 1760945 | | 4/2006 |
| CN | 1886774 | | 12/2006 |
| CN | 1897093 | A | 7/2007 |
| CN | 100375141 | C | 3/2008 |
| CN | 101164377 | A | 4/2008 |
| CN | 101194300 | A | 6/2008 |
| CN | 101300618 | A | 11/2008 |
| CN | 101315742 | A | 12/2008 |
| CN | 101449311 | | 6/2009 |
| CN | 101477783 | A | 7/2009 |
| CN | 101615376 | | 12/2009 |
| CN | 101763838 | A | 1/2010 |
| CN | 101923828 | A | 12/2010 |
| CN | 102187679 | A | 9/2011 |
| CN | 102414737 | A | 4/2012 |
| CN | 102656621 | | 9/2012 |
| CN | 102725786 | A | 10/2012 |
| CN | 102741910 | A | 10/2012 |
| CN | 103051917 | A | 4/2013 |
| CN | 103280162 | A | 9/2013 |
| DE | 20 2006 005427 | | 6/2006 |
| EP | 0 158 366 | | 10/1985 |
| EP | 0 940 796 | | 9/1999 |
| EP | 1 028 471 | | 8/2000 |
| EP | 1 103 947 | | 5/2001 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 467 408 | | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | A1 | 1/2008 |
| EP | 2395499 | A1 | 12/2011 |
| GB | 2 205 431 | | 12/1988 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-153759 | | 6/1998 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-077192 | | 3/2000 |
| JP | 2000-81607 | | 3/2000 |
| JP | 2000-0891998 | | 3/2000 |
| JP | 2000-352941 | | 12/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-229513 | | 8/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-124519 | | 4/2003 |
| JP | 2003-150082 | | 5/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-045648 | | 2/2004 |
| JP | 2004-145197 | | 5/2004 |
| JP | 2004-287345 | | 10/2004 |
| JP | 2005-057217 | | 3/2005 |
| JP | 2006-284970 | A | 10/2006 |
| JP | 2007-065015 | | 3/2007 |
| JP | 2007-155754 | | 6/2007 |
| JP | 2007-206590 | A | 8/2007 |
| JP | 2008-102335 | | 5/2008 |
| JP | 4-158570 | | 10/2008 |
| JP | 2003-195813 | | 7/2013 |
| KR | 2004-0100887 | | 12/2004 |
| TW | 342486 | | 10/1998 |
| TW | 473622 | | 1/2002 |
| TW | 485337 | | 5/2002 |

(56) References Cited

FOREIGN PATENT DOCUMENTS

| | | | |
|---|---|---|---|
| TW | 502233 | | 9/2002 |
| TW | 538650 | | 6/2003 |
| TW | 569173 | | 1/2004 |
| TW | 1221268 | | 9/2004 |
| TW | 1223092 | | 11/2004 |
| TW | I 248321 | A | 1/2006 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2003/105117 | | 12/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/066249 | A1 | 8/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO/2005/034072 | A1 | 4/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/090287 | A1 | 8/2007 |
| WO | WO 2007/120849 | A2 | 10/2007 |
| WO | WO 2009/048618 | | 4/2009 |
| WO | WO 2009/055920 | | 5/2009 |
| WO | WO 2009/127065 | | 10/2009 |
| WO | WO 2010/023270 | | 3/2010 |
| WO | WO 2010/146707 | A1 | 12/2010 |
| WO | WO 2011/041224 | A1 | 4/2011 |
| WO | WO 2011/064761 | A1 | 6/2011 |
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander : "Pixel circuits and drive schemes for glass and elastic AMOLED displays"; dated Jul. 2005 (9 pages).
Alexander : "Unique Electrical Measurement Technology for Compensation Inspection and Process Diagnostics of AMOLED HDTV"; dated May 2010 (4 pages).
Ashtiani : "AMOLED Pixel Circuit With Electronic Compensation of Luminance Degradation"; dated Mar. 2007 (4 pages).
Chaji : "A Current-Mode Comparator for Digital Calibration of Amorphous Silicon AMOLED Displays"; dated Jul. 2008 (5 pages).
Chaji : "A fast settling current driver based on the CCII for AMOLED displays"; dated Dec. 2009 (6 pages).
Chaji : "A Low-Cost Stable Amorphous Silicon AMOLED Display with Full V~T- and V~O~L~E~D Shift Compensation"; dated May 2007 (4 pages).
Chaji : "A low-power driving scheme for a-Si:H active-matrix organic light-emitting diode displays"; dated Jun. 2005 (4 pages).
Chaji : "A low-power high-performance digital circuit for deep submicron technologies"; dated Jun. 2005 (4 pages).
Chaji : "A novel a-Si:H AMOLED pixel circuit based on short-term stress stability of a-Si:H TFTs"; dated Oct. 2005 (3 pages).
Chaji : "A Novel Driving Scheme and Pixel Circuit for AMOLED Displays"; dated Jun. 2006 (4 pages).
Chaji : "A Novel Driving Scheme for High Resolution Large-area a-Si:H AMOLED displays"; dated Aug. 2005 (3 pages).
Chaji : "A Stable Voltage-Programmed Pixel Circuit for a-Si:H AMOLED Displays"; dated Dec. 2006 (12 pages).
Chaji : "A Sub- μA fast-settling current-programmed pixel circuit for AMOLED displays"; dated Sep. 2007.
Chaji : "An Enhanced and Simplified Optical Feedback Pixel Circuit for AMOLED Displays"; dated Oct. 2006.
Chaji : "Compensation technique for DC and transient instability of thin film transistor circuits for large-area devices"; dated Aug. 2008.
Chaji : "Driving scheme for stable operation of 2-TFT a-Si AMOLED pixel"; dated Apr. 2005 (2 pages).
Chaji : "Dynamic-effect compensating technique for stable a-Si:H AMOLED displays"; dated Aug. 2005 (4 pages).
Chaji : "Electrical Compensation of OLED Luminance Degradation"; dated Dec. 2007 (3 pages).
Chaji : "eUTDSP: a design study of a new VLIW-based DSP architecture"; dated May 2003 (4 pages).
Chaji : "Fast and Offset-Leakage Insensitive Current-Mode Line Driver for Active Matrix Displays and Sensors"; dated Feb. 2009 (8 pages).
Chaji : "High Speed Low Power Adder Design With a New Logic Style: Pseudo Dynamic Logic (SDL)"; dated Oct. 2001 (4 pages).
Chaji : "High-precision fast current source for large-area current-programmed a-Si flat panels"; dated Sep. 2006 (4 pages).
Chaji : "Low-Cost AMOLED Television with IGNIS Compensating Technology"; dated May 2008 (4 pages).
Chaji : "Low-Cost Stable a-Si:H AMOLED Display for Portable Applications"; dated Jun. 2006 (4 pages).
Chaji : "Low-Power Low-Cost Voltage-Programmed a-Si:H AMOLED Display"; dated Jun. 2008 (5 pages).
Chaji : "Merged phototransistor pixel with enhanced near infrared response and flicker noise reduction for biomolecular imaging"; dated Nov. 2008 (3 pages).
Chaji : "Parallel Addressing Scheme for Voltage-Programmed Active-Matrix OLED Displays"; dated May 2007 (6 pages).
Chaji : "Pseudo dynamic logic (SDL): a high-speed and low-power dynamic logic family"; dated 2002 (4 pages).
Chaji : "Stable a-Si:H circuits based on short-term stress stability of amorphous silicon thin film transistors"; dated May 2006 (4 pages).
Chaji : "Stable Pixel Circuit for Small-Area High-Resolution a-Si:H AMOLED Displays"; dated Oct. 2008 (6 pages).
Chaji : "Stable RGBW AMOLED display with OLED degradation compensation using electrical feedback"; dated Feb. 2010 (2 pages).
Chaji : "Thin-Film Transistor Integration for Biomedical Imaging and AMOLED Displays"; dated 2008 (177 pages).
European Search Report for Application No. EP 01 11 22313, dated Sep. 14, 2005 (4 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143 dated Sep. 3, 2010 (2 pages).
European Search Report and Written Opinion for Application No. 08 86 5338 dated Nov. 2, 2011 (7 pages).

(56) References Cited

OTHER PUBLICATIONS

European Search Report for Application No. EP 10 83 4294.0-1903 dated Apr. 8, 2013 (9 pages).
European Search Report for Application No. PCT/CA2006/000177 dated Jun. 2, 2006.
European Search Report for Application No. 05 82 1114 dated Mar. 27, 2009 (2 pages).
European Search Report for Application No. 10 00 0421.7, dated Mar. 26, (6 pages).
European Supplementary Search Report for Application No. EP 04 78 6662 dated Jan. 19, 2007 (2 pages)
Extended European Search Report for Application No. 11 73 9485.8 dated Aug. 6, 2013 (14 pages).
Extended European Search Report for Application No. EP 09 73 3076.5 dated Apr. 27, 2011 (13 pages).
Extended European Search Report for Application No. EP 11 16 8677.0 dated Nov. 29, 2012 (13 page).
Extended European Search Report for Application No. EP 11 19 1641.7 dated Jul. 11, 2012 (14 pages).
Extended European Search Report for Application No. EP 10834297 dated Oct. 27, 2014 (6 pages).
Extended European Search Report for Application No. EP 18172034.3 dated Jul. 16, 2018 (12 pages).
Fossum Eric R.. "Active Pixel Sensors: Are CCD's Dinosaurs?" SPIE: Symposium on Electronic Imaging. Feb. 1, 1993 (13 pages).
Goh "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Preliminary Report on Patentability for Application No. PCT/CA2005/001007 dated Oct. 16, 2006 4 pages.
International Search Report for Application No. PCT/CA2004/001741 dated Feb. 21, 2005.
International Search Report for Application No. PCT/CA2004/001742 Canadian Patent Office dated Feb. 21, 2005 (2 pages).
International Search Report for Application No. PCT/CA2005/001007 dated Oct. 18, 2005.
International Search Report for Application No. PCT/CA2005/001897 dated Mar. 21, 2006 (2 pages).
International Search Report for Application No. PCT/CA2007/000652 dated Jul. 25, 2007.
International Search Report for Application No. PCT/CA2009/000501 dated Jul. 30, 2009 (4 pages).
International Search Report for Application No. PCT/CA2009/001769 dated Apr. 8, 2010 (3 pages).
International Search Report for Application No. PCT/IB2010/055481 dated Apr. 7, 2011 3 pages.
International Search Report for Application No. PCT/IB2010/055486 dated Apr. 19, 2011 5 pages.
International Search Report for Application No. PCT/IB2014/060959 dated Aug. 28, 2014 5 pages.
International Search Report for Application No. PCT/IB2010/055541 filed Dec. 1, 2010 dated May 26, 2011; 5 pages.
International Search Report for Application No. PCT/IB2011/050502 dated Jun. 27, 2011 (6 pages).
International Search Report for Application No. PCT/IB2011/051103 dated Jul. 8, 2011 3 pages.
International Search Report for Application No. PCT/IB2011/055135 Canadian Patent Office dated Apr. 16, 2012 (5 pages).
International Search Report for Application No. PCT/IB2012/052372 dated Sep. 12, 2012 (3 pages).
International Search Report for Application No. PCT/IB2013/054251 Canadian Intellectual Property Office dated Sep. 11, 2013; (4 pages).
International Search Report for Application No. PCT/JP02/09668 dated Dec. 3, 2002 (4 pages).
International Search Report for Application No. PCT/CA02/00180 dated Jul. 31, 2002 (3 pages).
International Search Report for Application No. PCT/CA2005/001844 dated Mar. 28, 2006 (2 pages).
International Search Report for Application No. PCT/CA2008/002307, dated Apr. 28, 2009 (3 pages).
International Written Opinion for Application No. PCT/CA2004/001742 Canadian Patent Office dated Feb. 21, 2005 (5 pages).
International Written Opinion for Application No. PCT/CA2005/001897 dated Mar. 21, 2006 (4 pages).
International Written Opinion for Application No. PCT/CA2009/000501 dated Jul. 30, 2009 (6 pages).
International Written Opinion for Application No. PCT/IB2010/055481 dated Apr. 7, 2011 6 pages.
International Written Opinion for Application No. PCT/IB2010/055486 dated Apr. 19, 2011 8 pages.
International Written Opinion for Application No. PCT/IB2010/055541 dated May 26, 2011; 6 pages.
International Written Opinion for Application No. PCT/IB2011/050502 dated Jun. 27, 2011 (7 pages).
International Written Opinion for Application No. PCT/IB2011/051103 dated Jul. 8, 2011 6 pages.
International Written Opinion for Application No. PCT/IB2011/055135 Canadian Patent Office dated Apr. 16, 2012 (5 pages).
International Written Opinion for Application No. PCT/IB2012/052372 dated Sep. 12, 2012 (6 pages).
International Written Opinion for Application No. PCT/IB2013/054251 Canadian Intellectual Property Office dated Sep. 11, 2013; (5 pages).
Jafarabadiashtiani: "A New Driving Method for a-Si AMOLED Displays Based on Voltage Feedback"; dated 2005 (4 pages).
Kanicki J.; "Amorphous Silicon Thin-Film Transistors Based Active-Matrix Organic Light-Emitting Displays." Asia Display: International Display Workshops Sep. 2001 (pp. 315-318).
Karim K. S. "Amorphous Silicon Active Pixel Sensor Readout Circuit for Digital Imaging." IEEE: Transactions on Electron Devices. vol. 50 No. 1 Jan. 2003 (pp. 200-208).
Lee : "Ambipolar Thin-Film Transistors Fabricated by PECVD Nanocrystalline Silicon"; dated 2006.
Lee Wonbok: "Thermal Management in Microprocessor Chips and Dynamic Backlight Control in Liquid Crystal Displays" Ph.D. Dissertation University of Southern California, Aug. 2008 (124 pages).
Liu P. Innovative Voltage Driving Pixel Circuit Using Organic Thin-Film Transistor for AMOLEDs Journal of Display Technology vol. 5 Issue 6 Jun. 2009 (pp. 224-227).
Ma E Y: "organic light emitting diode/thin film transistor integration for foldable displays" dated Sep. 15, 1997(4 pages).
Matsueda y : "35.1: 2.5-in. AMOLED with Integrated 6-bit Gamma Compensated Digital Data Driver"; dated May 2004.
Mendes E. "A High Resolution Switch-Current Memory Base Cell." IEEE: Circuits and Systems. vol. 2 Aug. 1999 (pp. 718-721).
Nathan A. "Thin Film imaging technology on glass and plastic" ICM 2000 proceedings of the 12 international conference on microelectronics dated Oct. 31, 2001 (4 pages).
Nathan "Amorphous Silicon Thin Film Transistor Circuit Integration for Organic LED Displays on Glass and Plastic" IEEE Journal of Solid-State Circuits vol. 39 No. 9 Sep. 2004 pp. 1477-1486.
Nathan : "Backplane Requirements for active Matrix Organic Light Emitting Diode Displays"; dated 2006 (16 pages).
Nathan : "Call for papers second international workshop on compact thin-film transistor (TFT) modeling for circuit simulation"; dated Sep. 2009 (1 page).
Nathan : "Driving schemes for a-Si and LTPS AMOLED displays"; dated Dec. 2005 (11 pages).
Nathan : "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010 (8 pages).
Office Action in Japanese patent application No. JP2007-545796 dated Sep. 5, 2011 (8 pages).
Office Action in Chinese patent application No. 200910246264.4 dated Jul. 5, 2013 (8 pages).
Office Action in Japanese patent application No. JP2012-541612 dated Jul. 15, 2014. (3 pages).

(56) References Cited

OTHER PUBLICATIONS

Partial European Search Report for Application No. EP 11 168 677.0 dated Sep. 22, 2011 (5 pages).
Partial European Search Report for Application No. EP 11 19 1641.7 dated Mar. 20, 2012 (8 pages).
Philipp: "Charge transfer sensing" Sensor Review vol. 19 No. 2 Dec. 31, 1999 (Dec. 31, 1999) 10 pages.
Rafati : "Comparison of a 17 b multiplier in Dual-rail domino and in Dual-rail D L (D L) logic styles"; dated 2002 (4 pages).
Safavian : "3-TFT active pixel sensor with correlated double sampling readout circuit for real-time medical x-ray imaging"; dated Jun. 2006 (4 pages).
Safavian : "A novel current scaling active pixel sensor with correlated double sampling readout circuit for real time medical x-ray imaging"; dated May 2007 (7 pages).
Safavian : "A novel hybrid active-passive pixel with correlated double sampling CMOS readout circuit for medical x-ray imaging"; dated May 2008 (4 pages).
Safavian : "Self-compensated a-Si:H detector with current-mode readout circuit for digital X-ray fluoroscopy"; dated Aug. 2005 (4 pages).
Safavian : "TFT active image sensor with current-mode readout circuit for digital x-ray fluoroscopy [5969D-82]"; dated Sep. 2005 (9 pages).
Safavian : "Three-TFT image sensor for real-time digital X-ray imaging"; dated Feb. 2, 2006 (2 pages).
Sanford, James L.; "4.2 TFT AMOLED Pixel Circuits and Driving Methods"; SID 03 Digest, ISSN/0003, 2003, pp. 1-13.
Search Report for Taiwan Invention Patent Application No. 093128894 dated May 1, 2012 (1 page).
Search Report for Taiwan Invention Patent Application No. 94144535 dated Nov. 1, 2012 (1 page).
Singh "Current Conveyor: Novel Universal Active Block" Samriddhi S-JPSET vol. I Issue 1 2010 pp. 41-48 (12EPPT).
Smith Lindsay I. "A tutorial on Principal Components Analysis" dated Feb. 26, 2001 (27 pages).
Spindler System Considerations for RGBW OLED Displays Journal of the SID 14/1 2006 pp. 37-48.
Spindler et al.; "System Considerations for RGBW OLED Displays"; Journal of the SID 14/1, 2006, pp. 37-48.
Snorre Aunet: "switched capacitors circuits" University of Oslo Mar. 7, 2011 (Mar. 7, 2011) XP002729694 Retrieved from the Internet: URL:http://www.uio.no/studier/emner/matnat/ifi/INF4420/v11/undervisningsmateriale/INF4420_V11_0308_1.pdf [retrieved on Sep. 9, 2014].
Stewart M. "polysilicon TFT technology for active matrix oled displays" IEEE transactions on electron devices vol. 48 No. 5 dated May 2001 (7 pages).
Tatsuya Sasaoka et al.; "2.4.L; Late-News Paper: A 13.0-inch AM-Oled Display with Top Emitting Structure and Adaptive Current Mode Programmed Pixel Circuit (TAC)"; SID 01 Digest, 2001, pp. 384-387.
Vygranenko : "Stability of indium-oxide thin-film transistors by reactive ion beam assisted deposition"; dated 2009.
Wang : "Indium oxides by reactive ion beam assisted evaporation: From material study to device application"; dated Mar. 2009 (6 pages).
Written Opinion for Application No. PCT/IB2014/059409, Canadian Intellectual Property Office, dated Jun. 12, 2014 (5 pages).
Written Opinion for Application No. PCT/CA2009/000501 dated Jul. 30, 2009 (6 pages).
Yi He "Current-Source a-Si:H Thin Film Transistor Circuit for Active-Matrix Organic Light-Emitting Displays"; IEEE Electron Device Letters vol. 21 No. 12 Dec. 2000 pp. 590-592.
Yu Jennifer: "Improve OLED Technology for Display" Ph.D. Dissertation Massachusetts Institute of Technology Sep. 2008 (151 pages).
Zhiguo Meng et al.; "24.3: Active-Matrix Organic Light-Emitting Diode Display implemented Using Metal-Induced Unilaterally Crystallized Polycrystalline Silicon Thin-Film Transistors"; SID 01 Digest, 2001, pp. 380-383.
International Search Report for Application No. PCT/IB2014/058244 Canadian Intellectual Property Office dated Apr. 11, 2014; (6 pages).
International Search Report for Application No. PCT/IB2014/059753 Canadian Intellectual Property Office dated Jun. 23, 2014; (6 pages).
Written Opinion for Application No. PCT/IB2014/059753 Canadian Intellectual Property Office dated Jun. 12, 2014 (6 pages).
International Search Report for Application No. PCT/IB2014/060879 Canadian Intellectual Property Office dated Jul. 17, 2014 (3 pages).
International Search Report and Written Opinion of International Searching Authority for Application No. PCT/IB2014/059697 dated Oct. 15, 2014 (13 pages).
Extended European Search Report for Application No. EP 14158051.4 dated Jul. 29, 2014 (4 pages).
Office Action in Chinese Patent Invention No. 201180008188.9 dated Jun. 4, 2014 (17 pages).
International Search Report for Application No. PCT/IB/2014/066932 dated Mar. 24, 2015.
Written Opinion for Application No. PCT/IB/2014/066932 dated Mar. 24, 2015.
Extended European Search Report for Application No. EP 11866291.5 dated Mar. 9, 2015 (9 pages).
Extended European Search Report for Application No. EP 14181848.4 dated Mar. 5, 2015 (8 pages).
Office Action in Chinese Patent Invention No. 201280022957.5 dated Jun. 26, 2015 (7 pages).
Extended European Search Report for Application No. EP 13794695.0 dated Dec. 18, 2015 (9 pages).
Extended European Search Report for Application No. EP 16157746.5 dated Apr. 8, 2016 (11 pages).
Extended European Search Report for Application No. EP 16192749.6 dated Dec. 15, 2016 (17 pages).
International Search Report for Application No. PCT/IB/2016/054763 dated Nov. 25, 2016 (4 pages).
Written Opinion for Application No. PCT/IB/2016/054763 dated Nov. 25, 2016 (9 pages).
Extended European Search Report for Application No. EP 17195377.1 dated Feb. 12, 2018 (8 pages).
Extended European Search Report for Application No. EP 18150300.4 dated Mar. 14, 2018 (11 pages).
Jafarabadiashtiani, S.; "Pixel Circuits and Driving Schemes for Active-Matrix Organic Light-Emitting Diode Displays"; 2007 University of Waterloo, Electrical and Computer Engineering (188 pages).

* cited by examiner

STRUCTURAL AND LOW-FREQUENCY NON-UNIFORMITY COMPENSATION

CROSS-REFERENCE TO RELATED APPLICATIONS

This application is a continuation of U.S. patent application Ser. No. 14/255,132, filed Apr. 17, 2014, now allowed, which is a continuation-in-part of and claims priority to U.S. patent application Ser. No. 14/204,209, filed Mar. 11, 2014, Now U.S. Pat. No. 9,324,268, which claims the benefit of U.S. Provisional Application No. 61/787,397, filed Mar. 15, 2013, each of which is hereby incorporated by reference herein in its entirety.

U.S. patent application Ser. No. 14/255,132, filed Apr. 17, 2014, is also a continuation-in-part of and claims priority to U.S. patent application Ser. No. 13/689,241, filed Nov. 29, 2012, now U.S. Pat. No. 9,385,169, which claims the benefit of U.S. Provisional Application No. 61/564,634 filed Nov. 29, 2011, each of which is hereby incorporated by reference herein in its entirety.

FIELD OF THE INVENTION

The present disclosure generally relates to displays such as active matrix organic light emitting diode displays that monitor the values of selected parameters of the display and compensate for non-uniformities in the display.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age.

Some schemes for providing compensation to displays to account for variations across the display panel and over time utilize monitoring systems to measure time dependent parameters associated with the aging (i.e., degradation) and/or fabrication of the pixel circuits. The measured information can then be used to inform subsequent programming of the pixel circuits so as to ensure that any measured degradation is accounted for by adjustments made to the programming. Such monitored pixel circuits may require the use of additional transistors and/or lines to selectively couple the pixel circuits to the monitoring systems and provide for reading out information. The incorporation of additional transistors and/or lines may undesirably decrease pixel-pitch (i.e., "pixel density").

SUMMARY

In accordance with one embodiment, a system is provided for compensating for structural non-uniformities in an array of solid state devices in a display panel. The system displays images in the panel, and extracts the outputs of a pattern based on structural non-uniformities of the panel, across the panel, for each area of the structural non-uniformities. Then the non-uniformities are quantified, based on the values of the extracted outputs, and input signals to the display panel are modified to compensate for the non-uniformities.

In one implementation, the extracting is done with image sensors, such as optical sensors, associated with a pattern matching the structural non-uniformities. The non-uniformities may be modified at multiple response points by modifying the input signals, and the response points may be used to interpolate an entire response curve for the display panel. The response curve can then be used to create a compensated image.

In another implementation, black values are inserted for selected areas of said pattern to reduce the effect of optical cross talk.

In accordance with another embodiment, a system is provided for compensating for random non-uniformities in an array of solid state devices in a display panel. The system extracts low-frequency non-uniformities across the panel by applying patterns, and takes images of the pattern. The area and resolution of the image are adjusted to match the panel by creating values for pixels in the display, and then low-frequency non-uniformities across the panel are compensated, based on the created values.

In accordance with a further embodiment, a system is provided for compensating for non-uniformities in an array of solid state devices in a display panel. The system creates target points in the input-output characteristics of the panel, extracts structural non-uniformities by optical measurement using patterns matching the structural non-uniformities, compensates for the structural non-uniformities, extracts low-frequency non-uniformities by applying flat field and extracting the patterns, and compensates for the low-frequency non-uniformities.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
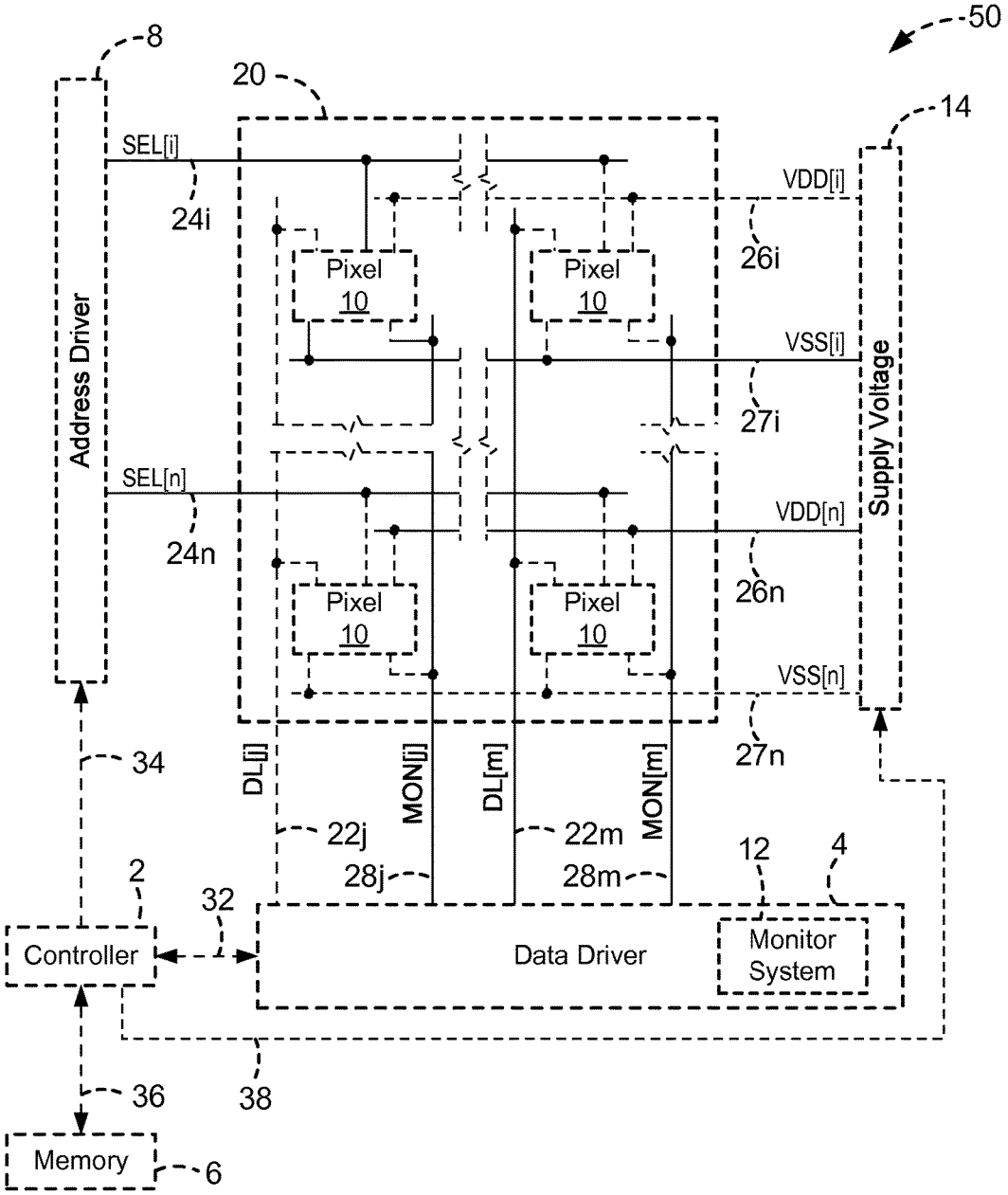
FIG. 1 is a block diagram of an exemplary configuration of a system for driving an OLED display while monitoring the degradation of the individual pixels and providing compensation therefor.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is a diagram of an exemplary display system 50. The display system 50 includes an address driver 8, a data driver 4, a controller 2, a memory 6, a supply voltage 14, and a display panel 20. The display panel 20 includes an array of pixels 10 arranged in rows and columns. Each of the pixels 10 is individually programmable to emit light with individually programmable luminance values. The controller 2 receives digital data indicative of information to be displayed on the display panel 20. The controller 2 sends signals 32 to the data driver 4 and scheduling signals 34 to the address driver 8 to drive the pixels 10 in the display panel 20 to display the information indicated. The plurality of pixels 10 associated with the display panel 20 thus comprise a display array ("display screen") adapted to dynamically display information according to the input digital data received by the controller 2. The display screen can display, for example, video information from a stream of video data received by the controller 2. The supply voltage 14 can provide a constant power voltage or can be an adjustable voltage supply that is controlled by signals from the controller 2. The display system 50 can also incorporate features from a current source or sink (not shown) to provide biasing currents to the pixels 10 in the display panel 20 to thereby decrease programming time for the pixels 10.

For illustrative purposes, the display system 50 in FIG. 1 is illustrated with only four pixels 10 in the display panel 20. It is understood that the display system 50 can be implemented with a display screen that includes an array of similar pixels, such as the pixels 10, and that the display screen is not limited to a particular number of rows and columns of pixels. For example, the display system 50 can be implemented with a display screen with a number of rows and columns of pixels commonly available in displays for mobile devices, monitor-based devices, and/or projection-devices.

Each pixel 10 includes a driving circuit ("pixel circuit") that generally includes a driving transistor and a light emitting device. Hereinafter the pixel 10 may refer to the pixel circuit. The light emitting device can optionally be an organic light emitting diode (OLED), but implementations of the present disclosure apply to pixel circuits having other electroluminescence devices, including current-driven light emitting devices. The driving transistor in the pixel 10 can optionally be an n-type or p-type amorphous silicon thin-film transistor, but implementations of the present disclosure are not limited to pixel circuits having a particular polarity of transistor or only to pixel circuits having thin-film transistors. The pixel circuit can also include a storage capacitor for storing programming information and allowing the pixel circuit to drive the light emitting device after being addressed. Thus, the display panel 20 can be an active matrix display array.

As illustrated in FIG. 1, the pixel 10 illustrated as the top-left pixel in the display panel 20 is coupled to a select line 24*i*, a supply line 26*i*, a data line 22*j*, and a monitor line 28*j*. A read line may also be included for controlling connections to the monitor line. In one implementation, the supply voltage 14 can also provide a second supply line to the pixel 10. For example, each pixel can be coupled to a first supply line 26 charged with Vdd and a second supply line 27 coupled with Vss, and the pixel circuits 10 can be situated between the first and second supply lines to facilitate driving current between the two supply lines during an emission phase of the pixel circuit. The top-left pixel 10 in the display panel 20 can correspond to a pixel in the display panel in a "ith" row and "jth" column of the display panel 20. Similarly, the top-right pixel 10 in the display panel 20 represents a "jth" row and "mth" column; the bottom-left pixel 10 represents an "nth" row and "jth" column; and the bottom-right pixel 10 represents an "nth" row and "mth" column. Each of the pixels 10 is coupled to appropriate select lines (e.g., the select lines 24*i* and 24*n*), supply lines (e.g., the supply lines 26*i* and 26*n*), data lines (e.g., the data lines 22*j* and 22*m*), and monitor lines (e.g., the monitor lines 28*j* and 28*m*). It is noted that aspects of the present disclosure apply to pixels having additional connections, such as connections to additional select lines, and to pixels having fewer connections, such as pixels lacking a connection to a monitoring line.

With reference to the top-left pixel 10 shown in the display panel 20, the select line 24*i* is provided by the address driver 8, and can be utilized to enable, for example, a programming operation of the pixel 10 by activating a switch or transistor to allow the data line 22*j* to program the pixel 10. The data line 22*j* conveys programming information from the data driver 4 to the pixel 10. For example, the data line 22*j* can be utilized to apply a programming voltage or a programming current to the pixel 10 in order to program the pixel 10 to emit a desired amount of luminance. The programming voltage (or programming current) supplied by the data driver 4 via the data line 22*j* is a voltage (or current) appropriate to cause the pixel 10 to emit light with a desired amount of luminance according to the digital data received by the controller 2. The programming voltage (or programming current) can be applied to the pixel 10 during a programming operation of the pixel 10 so as to charge a storage device within the pixel 10, such as a storage capacitor, thereby enabling the pixel 10 to emit light with the desired amount of luminance during an emission operation following the programming operation. For example, the storage device in the pixel 10 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 10, the driving current that is conveyed through the light emitting device by the driving transistor during the emission operation of the pixel 10 is a current that is supplied by the first supply line 26*i* and is drained to a second supply line 27*i*. The first supply line 26*i* and the second supply line 27*i* are coupled to the supply voltage 14. The first supply line 26*i* can provide a positive supply voltage (e.g., the voltage commonly referred to in circuit design as "Vdd") and the second supply line 27*i* can provide a negative supply voltage (e.g., the voltage commonly referred to in circuit design as "Vss"). Implementations of the present disclosure can be realized where one or the other of the supply lines (e.g., the supply line 27*i*) is fixed at a ground voltage or at another reference voltage.

The display system 50 also includes a monitoring system 12. With reference again to the top left pixel 10 in the display panel 20, the monitor line 28*j* connects the pixel 10 to the monitoring system 12. The monitoring system 12 can be integrated with the data driver 4, or can be a separate stand-alone system. In particular, the monitoring system 12 can optionally be implemented by monitoring the current and/or voltage of the data line 22*j* during a monitoring operation of the pixel 10, and the monitor line 28*j* can be entirely omitted. Additionally, the display system 50 can be implemented without the monitoring system 12 or the monitor line 28*j*. The monitor line 28*j* allows the monitoring system 12 to measure a current or voltage associated with the pixel 10 and thereby extract information indicative of a degradation of the pixel 10. For example, the monitoring system 12 can extract, via the monitor line 28*j*, a current flowing through the driving transistor within the pixel 10 and thereby determine, based on the measured current and based on the voltages applied to the driving transistor during the measurement, a threshold voltage of the driving transistor or a shift thereof.

The monitoring system 12 can also extract an operating voltage of the light emitting device (e.g., a voltage drop across the light emitting device while the light emitting device is operating to emit light). The monitoring system 12 can then communicate signals 32 to the controller 2 and/or the memory 6 to allow the display system 50 to store the extracted degradation information in the memory 6. During subsequent programming and/or emission operations of the pixel 10, the degradation information is retrieved from the memory 6 by the controller 2 via memory signals 36, and the controller 2 then compensates for the extracted degradation information in subsequent programming and/or emission operations of the pixel 10. For example, once the degradation information is extracted, the programming information conveyed to the pixel 10 via the data line 22*j* can be appropriately adjusted during a subsequent programming operation of the pixel 10 such that the pixel 10 emits light with a desired amount of luminance that is independent of the degradation of the pixel 10. In an example, an increase in the threshold voltage of the driving transistor within the pixel 10 can be compensated for by appropriately increasing the programming voltage applied to the pixel 10.

Figure 2A:
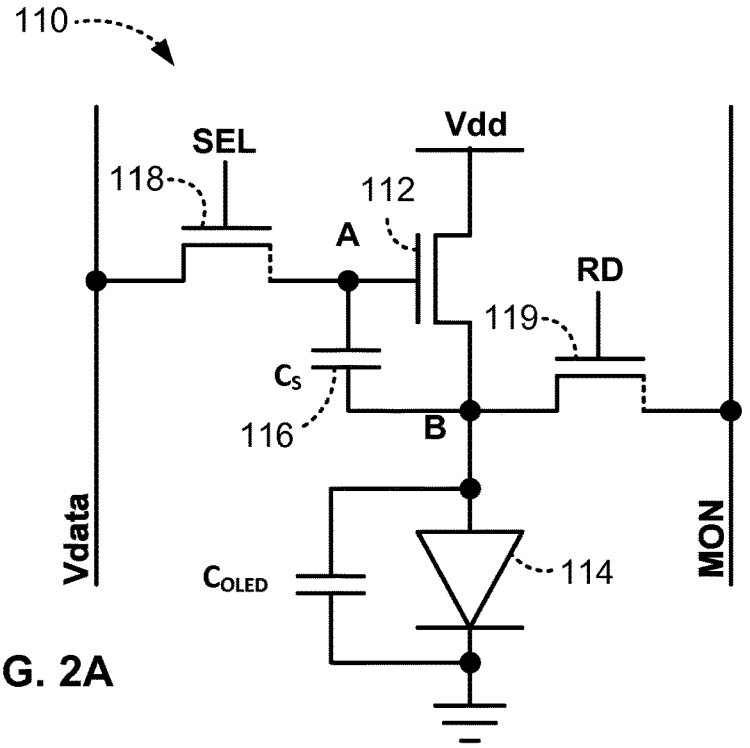
FIG. 2A is a circuit diagram of an exemplary pixel circuit configuration.

FIG. 2A is a circuit diagram of an exemplary driving circuit for a pixel 110. The driving circuit shown in FIG. 2A is utilized to calibrate, program and drive the pixel 110 and includes a drive transistor 112 for conveying a driving current through an organic light emitting diode (OLED) 114. The OLED 114 emits light according to the current passing through the OLED 114, and can be replaced by any current-driven light emitting device. The OLED 114 has an inherent capacitance $C_{OLED}$. The pixel 110 can be utilized in the display panel 20 of the display system 50 described in connection with FIG. 1.

The driving circuit for the pixel 110 also includes a storage capacitor 116 and a switching transistor 118. The pixel 110 is coupled to a select line SEL, a voltage supply line Vdd, a data line Vdata, and a monitor line MON. The driving transistor 112 draws a current from the voltage supply line Vdd according to a gate-source voltage (Vgs) across the gate and source terminals of the drive transistor 112. For example, in a saturation mode of the drive transistor 112, the current passing through the drive transistor 112 can be given by $Ids=\beta\ (Vgs-Vt)^2$, where β is a parameter that depends on device characteristics of the drive transistor 112, Ids is the current from the drain terminal to the source terminal of the drive transistor 112, and Vt is the threshold voltage of the drive transistor 112.

In the pixel 110, the storage capacitor 116 is coupled across the gate and source terminals of the drive transistor 112. The storage capacitor 116 has a first terminal, which is referred to for convenience as a gate-side terminal, and a second terminal, which is referred to for convenience as a source-side terminal. The gate-side terminal of the storage capacitor 116 is electrically coupled to the gate terminal of the drive transistor 112. The source-side terminal 116*s* of the storage capacitor 116 is electrically coupled to the source terminal of the drive transistor 112. Thus, the gate-source voltage Vgs of the drive transistor 112 is also the voltage charged on the storage capacitor 116. As will be explained further below, the storage capacitor 116 can thereby maintain a driving voltage across the drive transistor 112 during an emission phase of the pixel 110.

The drain terminal of the drive transistor 112 is connected to the voltage supply line Vdd, and the source terminal of the drive transistor 112 is connected to (1) the anode terminal of the OLED 114 and (2) a monitor line MON via a read transistor 119. A cathode terminal of the OLED 114 can be connected to ground or can optionally be connected to a second voltage supply line, such as the supply line Vss shown in FIG. 1. Thus, the OLED 114 is connected in series with the current path of the drive transistor 112. The OLED 114 emits light according to the magnitude of the current passing through the OLED 114, once a voltage drop across the anode and cathode terminals of the OLED achieves an operating voltage ($V_{OLED}$) of the OLED 114. That is, when the difference between the voltage on the anode terminal and the voltage on the cathode terminal is greater than the operating voltage $V_{OLED}$, the OLED 114 turns on and emits light. When the anode-to-cathode voltage is less than $V_{OLED}$, current does not pass through the OLED 114.

The switching transistor 118 is operated according to the select line SEL (e.g., when the voltage on the select line SEL is at a high level, the switching transistor 118 is turned on, and when the voltage SEL is at a low level, the switching transistor is turned off). When turned on, the switching transistor 118 electrically couples node A (the gate terminal of the driving transistor 112 and the gate-side terminal of the storage capacitor 116) to the data line Vdata.

The read transistor 119 is operated according to the read line RD (e.g., when the voltage on the read line RD is at a high level, the read transistor 119 is turned on, and when the voltage RD is at a low level, the read transistor 119 is turned off). When turned on, the read transistor 119 electrically couples node B (the source terminal of the driving transistor 112, the source-side terminal of the storage capacitor 116, and the anode of the OLED 114) to the monitor line MON.

Figure 2B:
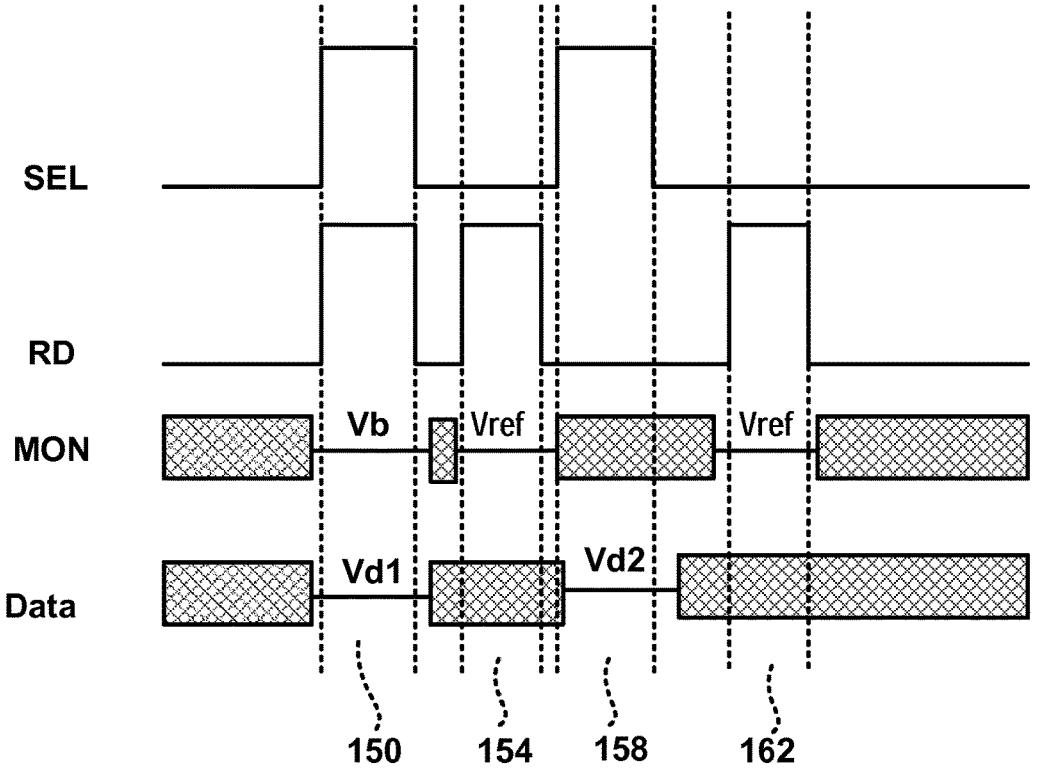
FIG. 2B is a timing diagram of first exemplary operation cycles for the pixel shown in FIG. 2A.

FIG. 2B is a timing diagram of exemplary operation cycles for the pixel 110 shown in FIG. 2A. During a first cycle 150, both the SEL line and the RD line are high, so the corresponding transistors 118 and 119 are turned on. The switching transistor 118 applies a voltage Vd1, which is at a level sufficient to turn on the drive transistor 112, from the data line Vdata to node A. The read transistor 119 applies a monitor-line voltage Vb, which is at a level that turns the OLED 114 off, from the monitor line MON to node B. As a result, the gate-source voltage Vgs is independent of $V_{OLED}$ (Vd1−Vb−Vds3, where Vds3 is the voltage drop across the read transistor 119). The SEL and RD lines go low at the end of the cycle 150, turning off the transistors 118 and 119.

During the second cycle 154, the SEL line is low to turn off the switching transistor 118, and the drive transistor 112 is turned on by the charge on the capacitor 116 at node A. The voltage on the read line RD goes high to turn on the read transistor 119 and thereby permit a first sample of the drive transistor current to be taken via the monitor line MON, while the OLED 114 is off. The voltage on the monitor line MON is Vref, which may be at the same level as the voltage Vb in the previous cycle.

During the third cycle 158, the voltage on the select line SEL is high to turn on the switching transistor 118, and the voltage on the read line RD is low to turn off the read transistor 119. Thus, the gate of the drive transistor 112 is charged to the voltage Vd2 of the data line Vdata, and the source of the drive transistor 112 is set to $V_{OLED}$ by the OLED 114. Consequently, the gate-source voltage Vgs of the drive transistor 112 is a function of $V_{OLED}$ (Vgs=Vd2−$V_{OLED}$).

During the fourth cycle 162, the voltage on the select line SEL is low to turn off the switching transistor, and the drive transistor 112 is turned on by the charge on the capacitor 116 at node A. The voltage on the read line RD is high to turn on the read transistor 119, and a second sample of the current of the drive transistor 112 is taken via the monitor line MON.

If the first and second samples of the drive current are not the same, the voltage Vd2 on the Vdata line is adjusted, the programming voltage Vd2 is changed, and the sampling and adjustment operations are repeated until the second sample of the drive current is the same as the first sample. When the two samples of the drive current are the same, the two gate-source voltages should also be the same, which means that:

$$\begin{aligned} V_{OLED} &= Vd2 - Vgs \\ &= Vd2 - (Vd1 - Vb - Vds3) \\ &= Vd2 - Vd1 + Vb + Vds3. \end{aligned}$$

After some operation time (t), the change in $V_{OLED}$ between time 0 and time t is $\Delta V_{OLED}=V_{OLED}(t)-V_{OLED}(0)$=Vd2(t)−Vd2(0). Thus, the difference between the two programming voltages Vd2(t) and Vd2(0) can be used to extract the OLED voltage.

Figure 2C:
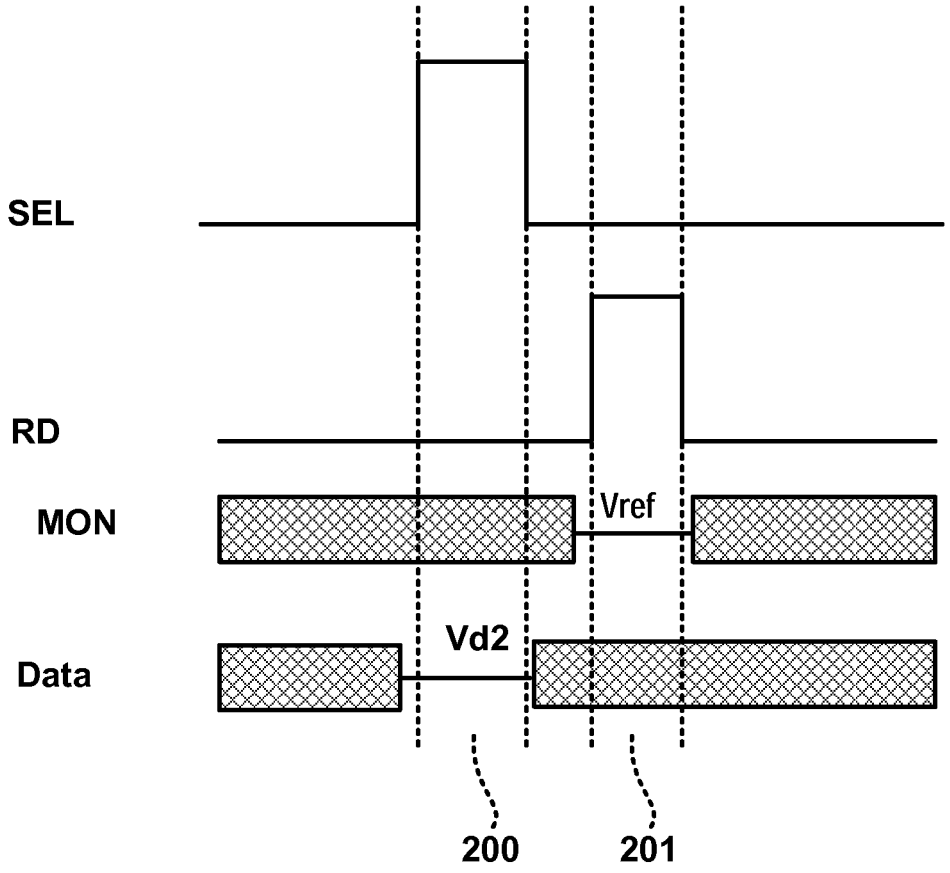
FIG. 2C is a timing diagram of second exemplary operation cycles for the pixel shown in FIG. 2A.

FIG. 2C is a modified schematic timing diagram of another set of exemplary operation cycles for the pixel 110 shown in FIG. 2A, for taking only a single reading of the drive current and comparing that value with a known reference value. For example, the reference value can be the desired value of the drive current derived by the controller to compensate for degradation of the drive transistor 112 as it ages. The OLED voltage $V_{OLED}$ can be extracted by measuring the difference between the pixel currents when the pixel is programmed with fixed voltages in both methods (being affected by $V_{OLED}$ and not being affected by $V_{OLED}$). This difference and the current-voltage characteristics of the pixel can then be used to extract $V_{OLED}$.

During the first cycle 200 of the exemplary timing diagram in FIG. 2C, the select line SEL is high to turn on the switching transistor 118, and the read line RD is low to turn off the read transistor 118. The data line Vdata supplies a voltage Vd2 to node A via the switching transistor 118. During the second cycle 201, SEL is low to turn off the switching transistor 118, and RD is high to turn on the read transistor 119. The monitor line MON supplies a voltage Vref to the node B via the read transistor 118, while a reading of the value of the drive current is taken via the read transistor 119 and the monitor line MON. This read value is compared with the known reference value of the drive current and, if the read value and the reference value of the drive current are different, the cycles 200 and 201 are repeated using an adjusted value of the voltage Vd2. This process is repeated until the read value and the reference value of the drive current are substantially the same, and then the adjusted value of Vd2 can be used to determine $V_{OLED}$.

Figure 3:
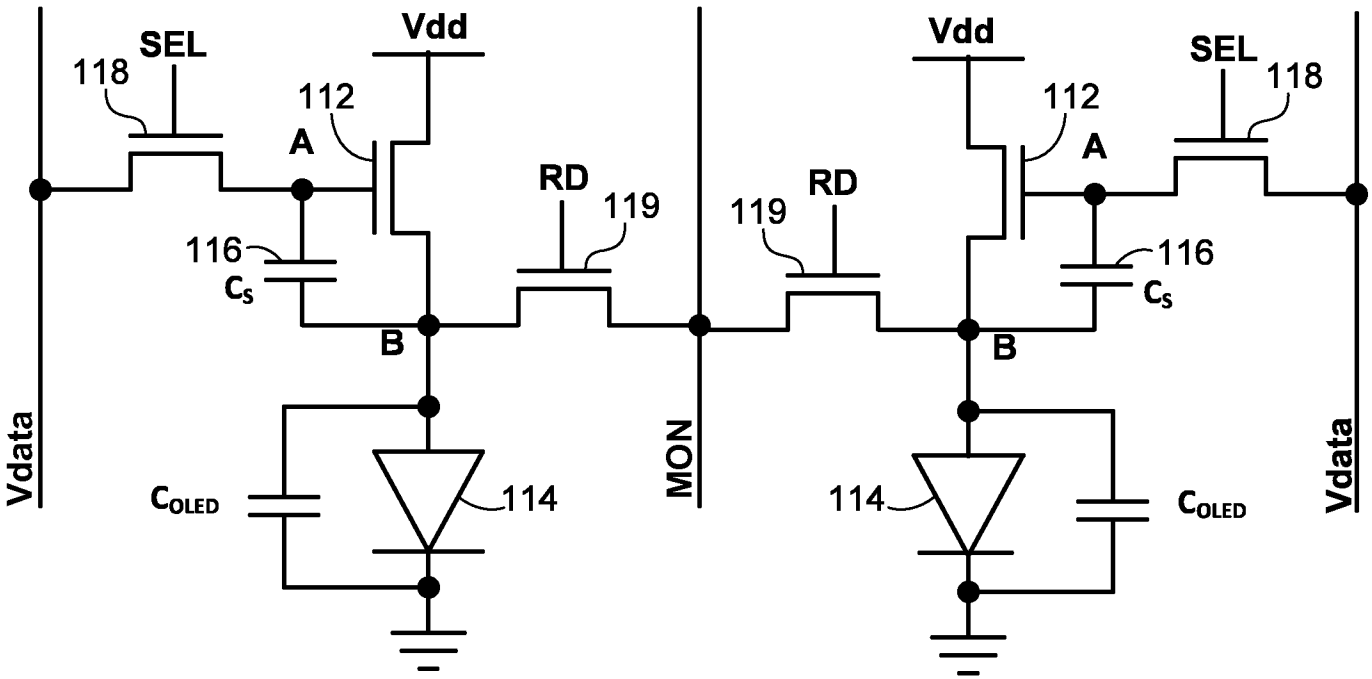
FIG. 3 is a circuit diagram of another exemplary pixel circuit configuration.

FIG. 3 is a circuit diagram of two of the pixels 110*a* and 110*b* like those shown in FIG. 2A but modified to share a common monitor line MON, while still permitting independent measurement of the driving current and OLED voltage separately for each pixel. The two pixels 110*a* and 110*b* are in the same row but in different columns, and the two columns share the same monitor line MON. Only the pixel selected for measurement is programmed with valid voltages, while the other pixel is programmed to turn off the drive transistor 12 during the measurement cycle. Thus, the drive transistor of one pixel will have no effect on the current measurement in the other pixel.

Figure 4:
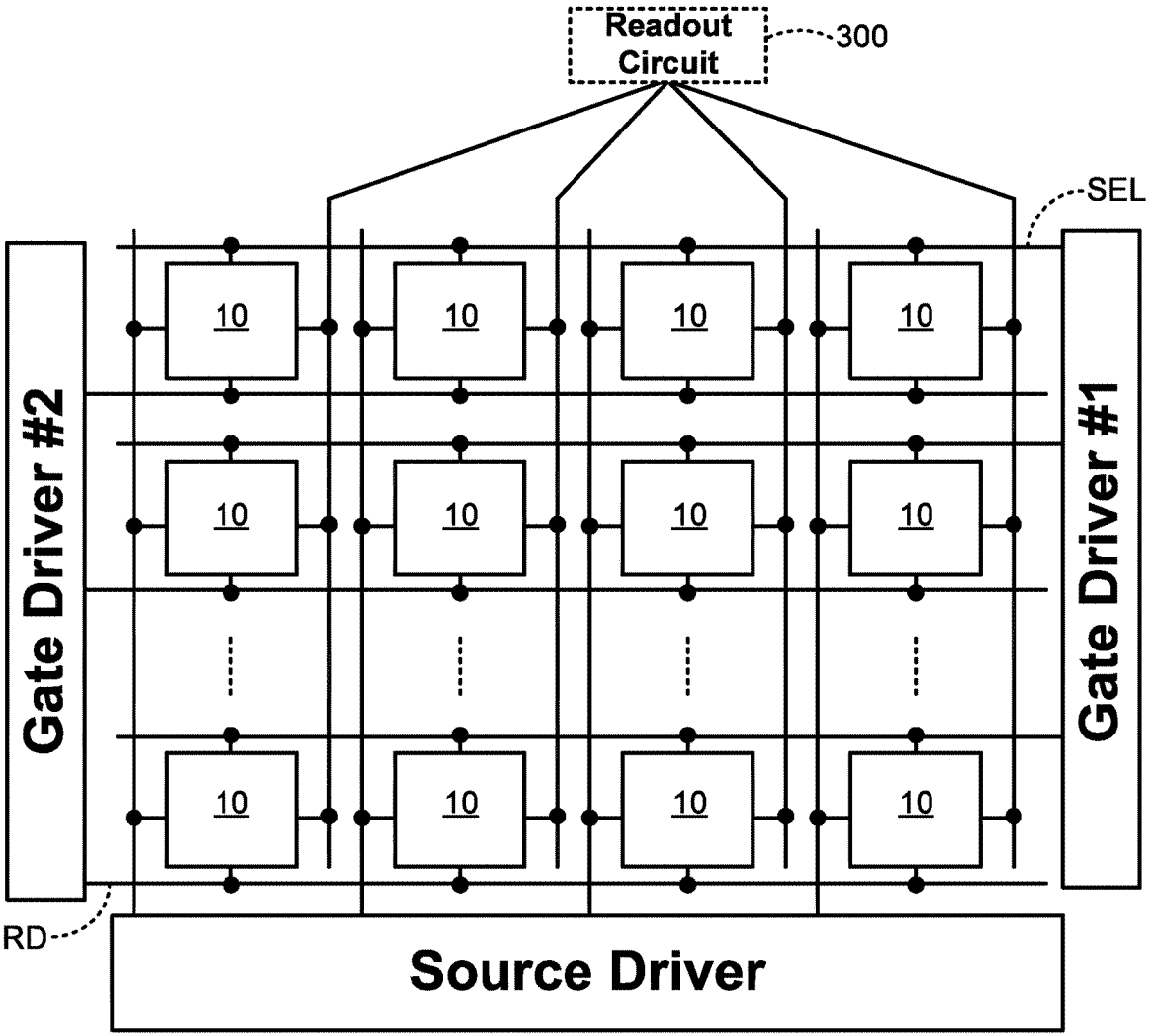
FIG. 4 is a block diagram of a modified configuration of a system for driving an OLED display using a shared readout circuit, while monitoring the degradation of the individual pixels and providing compensation therefor.

FIG. 4 illustrates a drive system that utilizes a readout circuit (ROC) 300 that is shared by multiple columns of pixels while still permitting the measurement of the driving current and OLED voltage independently for each of the individual pixels 10. Although only four columns are illustrated in FIG. 4, it will be understood that a typical display contains a much larger number of columns. Multiple readout circuits can be utilized, with each readout circuit sharing multiple columns, so that the number of readout circuits is significantly less than the number of columns. Only the pixel selected for measurement at any given time is programmed with valid voltages, while all the other pixels sharing the same gate signals are programmed with voltages that cause the respective drive transistors to be off. Consequently, the drive transistors of the other pixels will have no effect on the current measurement being taken of the selected pixel. Also, when the driving current in the selected pixel is used to measure the OLED voltage, the measurement of the OLED voltage is also independent of the drive transistors of the other pixels.

Figure 5:
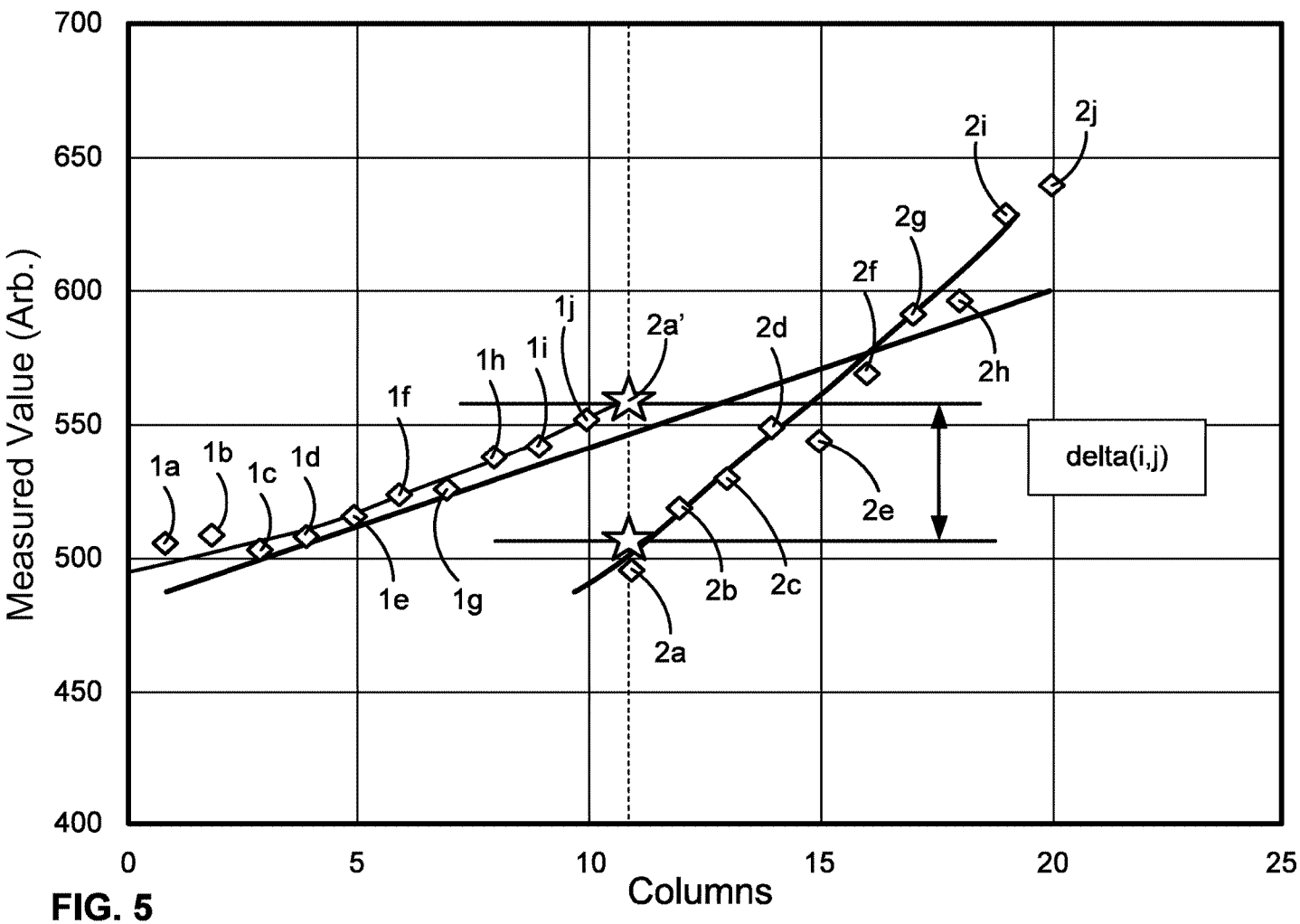
FIG. 5 is an example of measurements taken by two different readout circuits from adjacent groups of pixels in the same row.

When multiple readout circuits are used, multiple levels of calibration can be used to make the readout circuits identical. However, there are often remaining non-uniformities among the readout circuits that measure multiple columns, and these non-uniformities can cause steps in the measured data across any given row. One example of such a step is illustrated in FIG. 5 where the measurements 1*a*-1*j* for columns 1-10 are taken by a first readout circuit, and the measurements 2*a*-2*j* for columns 11-20 are taken by a second readout circuit. It can be seen that there is a significant step between the measurements 1*j* and 2*a* for the adjacent columns 10 and 11, which are taken by different readout circuits. To adjust this non-uniformity between the last of a first group of measurements made in a selected row by the first readout circuit, and the first of an adjacent second group of measurements made in the same row by the second readout circuit, an edge adjustment can be made by processing the measurements in a controller coupled to the readout circuits and programmed to:

(1) determine a curve fit for the values of the parameter(s) measured by the first readout circuit (e.g., values 1*a*-1*j* in FIG. 5), (2) determine a first value 2*a*' of the parameter(s) of the first pixel in the second group from the curve fit for the values measured by the first readout circuit, (3) determine a second value 2*a* of the parameter(s) measured for the first pixel in the second group from the values measured by the second readout circuit, (4) determine the difference (2*a*'-2*a*), or "delta value," between the first and second values for the first pixel in the second group, and (5) adjust the values of the remaining parameter(s) 2*b*-2*j* measured for the second group of pixels by the second readout circuit, based on the difference between the first and second values for the first pixel in the second group.

This process is repeated for each pair of adjacent pixel groups measured by different readout circuits in the same row.

The above adjustment technique can be executed on each row independently, or an average row may be created based on a selected number of rows. Then the delta values are calculated based on the average row, and all the rows are adjusted based on the delta values for the average row.

Another technique is to design the panel in a way that the boundary columns between two readout circuits can be measured with both readout circuits. Then the pixel values in each readout circuit can be adjusted based on the difference between the values measured for the boundary columns, by the two readout circuits.

If the variations are not too great, a general curve fitting (or low pass filter) can be used to smooth the rows and then the pixels can be adjusted based on the difference between real rows and the created curve. This process can be executed for all rows based on an average row, or for each row independently as described above.

The readout circuits can be corrected externally by using a single reference source (or calibrated sources) to adjust each ROC before the measurement. The reference source can be an outside current source or one or more pixels calibrated externally. Another option is to measure a few sample pixels coupled to each readout circuit with a single measurement readout circuit, and then adjust all the readout circuits based on the difference between the original measurement and the measured values made by the single measurement readout circuit.

Figure 6:
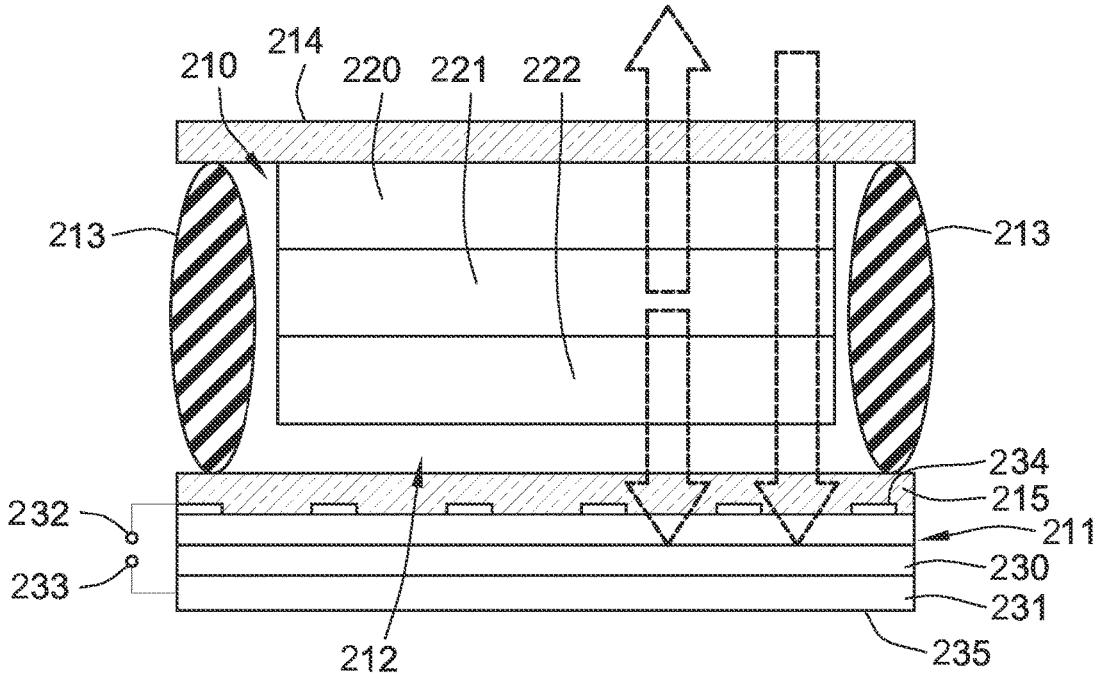
FIG. 6 is a sectional view of an active matrix display that includes integrated solar cell and semi-transparent OLED layers.

FIG. 6 illustrates a display system that includes a semitransparent OLED layer 10 integrated with a solar panel 11 separated from the OLED layer 10 by an air gap 12. The OLED layer 10 includes multiple pixels arranged in an X-Y matrix that is combined with programming, driving and control lines connected to the different rows and columns of the pixels. A peripheral sealant 13 (e.g., epoxy) holds the two layers 10 and 11 in the desired positions relative to each other. The OLED layer 210 has a glass substrate 214, the solar panel 11 has a glass cover 15, and the sealant 13 is bonded to the opposed surfaces of the substrate 14 and the cover 15 to form an integrated structure.

The OLED layer 210 includes a substantially transparent anode 220, e.g., indium-tin-oxide (ITO), adjacent the glass substrate 214, an organic semiconductor stack 221 engaging the rear surface of the anode 220, and a cathode 222 engaging the rear surface of the stack 221. The cathode 222 is made of a transparent or semi-transparent material, e.g., thin silver (Ag), to allow light to pass through the OLED layer 210 to the solar panel 211. (The anode 220 and the semiconductor stack 221 in OLEDs are typically at least semi-transparent, but the cathode in previous OLEDs has often been opaque and sometimes even light-absorbing to minimize the reflection of ambient light from the OLED.)

Light that passes rearwardly through the OLED layer 210, as illustrated by the right-hand arrow in FIG. 6, continues on through the air gap 212 and the cover glass cover 215 of the solar cell 211 to the junction between n-type and p-type semiconductor layers 230 and 231 in the solar cell. Optical energy passing through the glass cover 215 is converted to electrical energy by the semiconductor layers 230 and 231, producing an output voltage across a pair of output terminals 232 and 233. The various materials that can be used in the layers 230 and 231 to convert light to electrical energy, as well as the material dimensions, are well known in the solar cell industry. The positive output terminal 232 is connected to the n-type semiconductor layer 230 (e.g., copper phthalocyanine) by front electrodes 234 attached to the front surface of the layer 230. The negative output terminal 233 is connected to the p-type semiconductor layer 231 (e.g., 3, 4, 9, 10-perylenetetracarboxylic bis-benzimidazole) by rear electrodes 235 attached to the rear surface of the layer 231.

One or more switches may be connected to the terminals 232 and 233 to permit the solar panel 211 to be controllably connected to either (1) an electrical energy storage device such as a rechargeable battery or one or more capacitors, or (2) to a system that uses the solar panel 211 as a touch screen, to detect when and where the front of the display is "touched" by a user.

In the illustrative embodiment of FIG. 6, the solar panel 211 is used to form part of the encapsulation of the OLED layer 210 by forming the rear wall of the encapsulation for the entire display. Specifically, the cover glass 215 of the solar cell array forms the rear wall of the encapsulation for the OLED layer 210, the single glass substrate 214 forms the front wall, and the perimeter sealant 213 forms the side walls.

One example of a suitable semitransparent OLED layer 210 includes the following materials:

Anode 220

ITO (100 nm)

Semiconductor Stack 221 hole transport layer—N,N'-bis(naphthalen-1-yl)-N,N'-bis (phenyl)benzidine (NBP) (70 nm)

emitter layer—tris(8-hydroxyquinoline) aluminum ($Alq_3$): 10-(2-benzothiazolyl)-1, 1, 7, 7-tetramethyl-2, 3, 6, 7-tetrahydro-1H, 5H, 11H, [l] benzo-pyrano [6,7, 8-ij] quinolizin-11-one (C545T) (99%:1%) (30 nm)

electron transport layer—Alq3 (40 nm)

electron injection layer—4,7-diphenyl-1,10-phenanthroline (Bphen): (Cs2CO3) (9:1) (10 nm)

Semitransparent Cathode 222

MoO3:NPB(1:1) (20 nm)

Ag (14 nm)

MoO3:NPB(1:1) (20 nm)

The performance of the above OLED layer in an integrated device using a commercial solar panel was compared with a reference device, which was an OLED with exactly the same semiconductor stack and a metallic cathode (Mg/Ag). The reflectance of the reference device was very high, due to the reflection of the metallic electrode; in contrast, the reflectance of the integrated device is very low. The reflectance of the integrated device with the transparent electrode was much lower than the reflectances of both the reference device (with the metallic electrode) and the reference device equipped with a circular polarizer.

Figure 7:
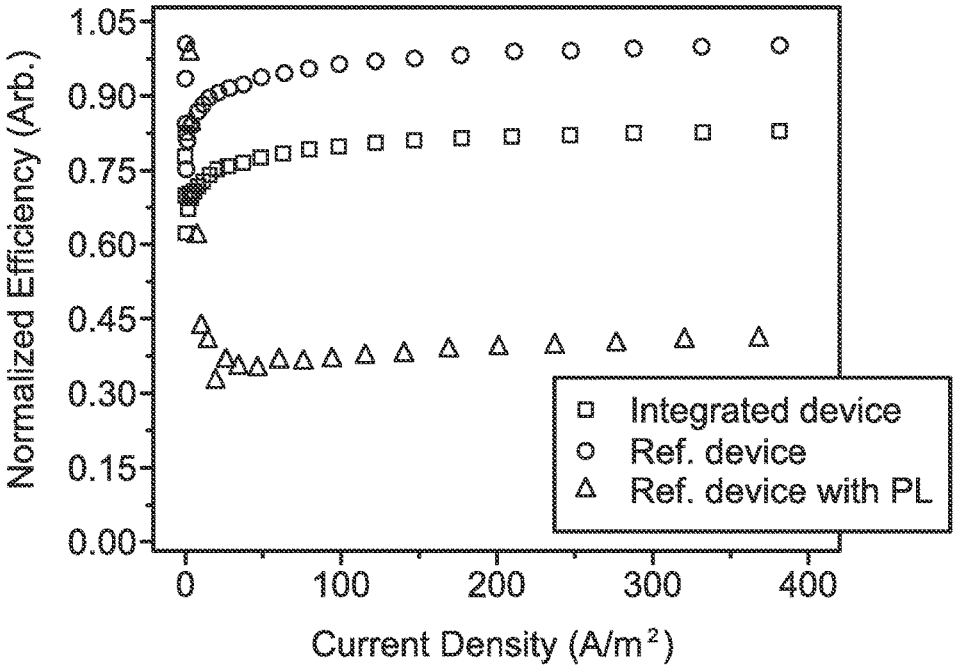
FIG. 7 is a plot of current efficiency vs. current density for the integrated device of FIG. 6 and a reference device.

The current efficiency-current density characteristics of the integrated device with the transparent electrode and the reference device are shown in FIG. 7. At a current density of 200 $A/m^2$, the integrated device with the transparent electrode had a current efficiency of 5.88 cd/A, which was 82.8% of the current efficiency (7.1 cd/A) of the reference device. The current efficiency of the reference device with a circular polarizer was only 60% of the current efficiency of the reference device. The integrated device converts both the incident ambient light and a portion of the OLED internal luminance into useful electrical energy instead of being wasted.

For both the integrated device and the reference device described above, all materials were deposited sequentially at a rate of 1-3 Å/s using vacuum thermal evaporation at a pressure below $5\times10^{-6}$ Torr on ITO-coated glass substrates. The substrates were cleaned with acetone and isopropyl alcohol, dried in an oven, and finally cleaned by UV ozone treatment before use. In the integrated device, the solar panel was a commercial Sanyo Energy AM-1456CA amorphous silicon solar cell with a short circuit current of 6 μA and a voltage output of 2.4V. The integrated device was fabricated using the custom cut solar cell as encapsulation glass for the OLED layer.

The optical reflectance of the device was measured by using a Shimadzu UV-2501PC UV-Visible spectrophotometer. The current density (J)-luminance (L)-voltage (V) characteristics of the device was measured with an Agilent 4155C semiconductor parameter analyzer and a silicon photodiode pre-calibrated by a Minolta Chromameter. The ambient light was room light, and the tests were carried out at room temperature. The performances of the fabricated devices were compared with each other and with the reference device equipped with a circular polarizer.

Figure 8:
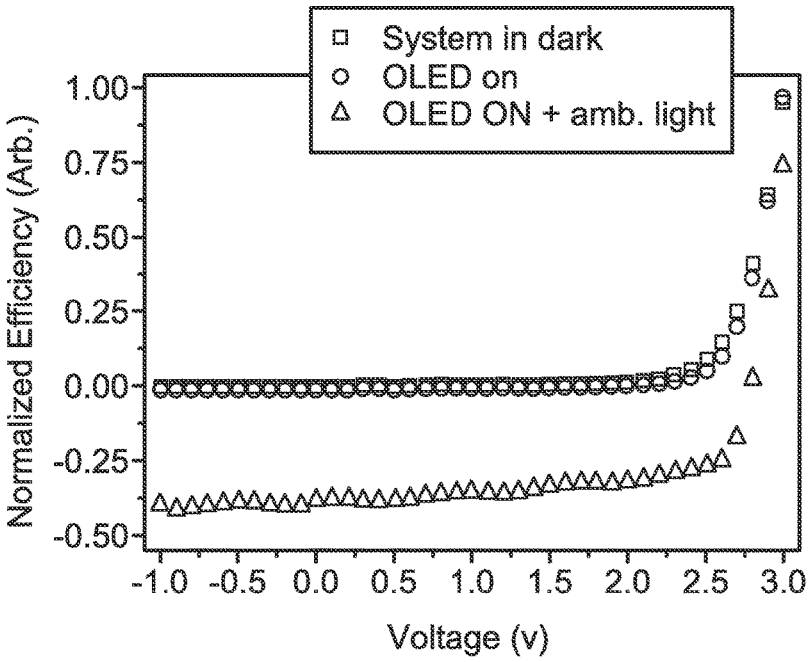
FIG. 8 is a plot of current efficiency vs. voltage for the integrated device of FIG. 6 with the solar cell in a dark environment, under illumination of the OLED layer, and under illumination of both the OLED layer and ambient light.

FIG. 8 shows current-voltage (I-V) characteristics of the solar panel (1) in dark, (20 under the illumination of OLED, and (3) under illumination of both ambient light and the OLED at 20 $mA/cm^2$. The dark current of the solar cell shows a nice diode characteristic. When the solar cell is under the illumination of the OLED under 20 $mA/cm^2$ current density, the solar cell shows a short circuit current ($I_{sc}$) of −0.16 μA, an open circuit voltage ($V_{oc}$) of 1.6V, and a filling factor (FF) of 0.31. The maximum converted electrical power is 0.08 μW, which demonstrates that the integrated device is capable of recycling a portion of the internal OLED luminance energy. When the solar cell is under the illumination of both ambient light and the overlying OLED, the solar cell shows a short circuit current ($I_{sc}$) of −7.63 μA, an open circuit voltage ($V_{oc}$) of 2.79V, and a filling factor (FF) of 0.65. The maximum converted electrical power is 13.8 μW in this case. The increased electrical power comes from the incident ambient light.

Overall, the integrated device shows a higher current efficiency than the reference device with a circular polarizer, and further recycles the energy of the incident ambient light and the internal luminance of the top OLED, which demonstrates a significant low power consumption display system.

Conventional touch displays stack a touch panel on top of an LCD or AMOLED display. The touch panel reduces the luminance output of the display beneath the touch panel and adds extra cost to the fabrication. The integrated device described above is capable of functioning as an optical-based touch screen without any extra panels or cost. Unlike previous optical-based touch screens which require extra IR-LEDs and sensors, the integrated device described here utilizes the internal illumination from the top OLED as an optical signal, and the solar cell is utilized as an optical sensor. Since the OLED has very good luminance uniformity, the emitted light is evenly spread across the device surface as well as the surface of the solar panel. When the front surface of the display is touched by a finger or other object, a portion of the emitted light is reflected off the object back into the device and onto the solar panel, which changes the electrical output of the solar panel. The system is able to detect this change in the electrical output, thereby detecting the touch. The benefit of this optical-based touch system is that it works for any object (dry finger, wet finger, gloved finger, stylus, pen, etc.), because detection of the touch is based on the optical reflection rather than a change in the refractive index, capacitance or resistance of the touch panel.

Figure 9:
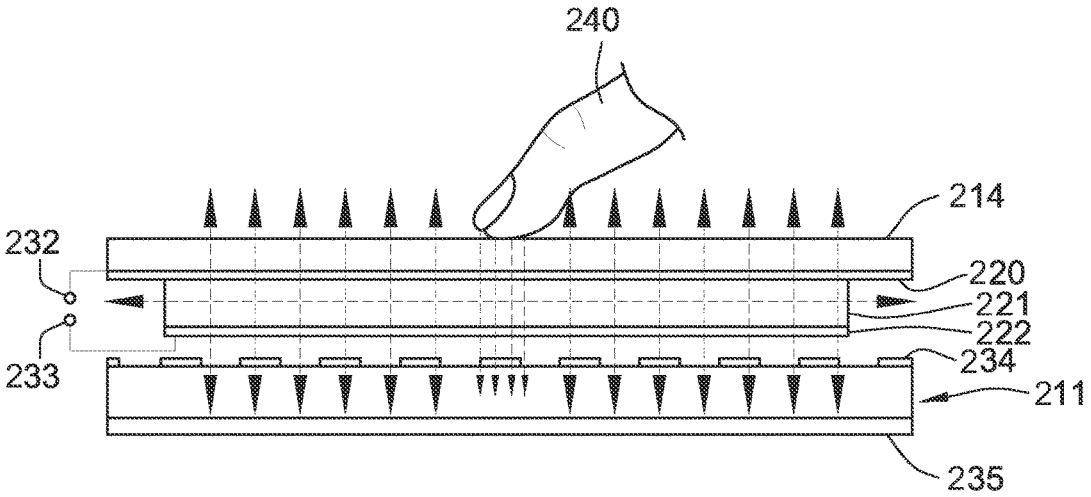
FIG. 9 is a diagrammatic illustration of the integrated device of FIG. 6 operating as an optical-based touch screen.

FIG. 9 is a diagrammatic illustration of the integrated device of FIG. 6 being used as a touch screen. To allow the solar cell to convert a significant amount of light that impinges on the front of the cell, the front electrodes 234 are spaced apart to leave a large amount of open area through which impinging light can pass to the front semiconductor layer 230. The illustrative electrode pattern in FIG. 9 has all the front electrodes 234 extending in the X direction, and all the back contacts 235 extending in the Y direction. Alternatively, one electrode can be patterned in both directions. An additional option is the addition of tall wall traces covered with metal so that they can be connected to the OLED transparent electrode to further reduce the resistance. Another option is to fill the gap 212 between the OLED layer 10 and the cover glass 215 with a transparent material that acts as an optical glue, for better light transmittance.

When the front of the display is touched or obstructed by a finger 240 (FIG. 9) or other object that reflects or otherwise changes the amount of light impinging on the solar panel at a particular location, the resulting change in the electrical output of the solar panel can be detected. The electrodes 234 and 235 are all individually connected to a touch screen controller circuit that monitors the current levels in the individual electrodes, and/or the voltage levels across different pairs of electrodes, and analyzes the location responsible for each change in those current and/or voltage levels. Touch screen controller circuits are well known in the touch-screen industry, and are capable of quickly and accurately reading the exact position of a "touch" that causes a change in the electrode currents and/or voltages being monitored. The touch screen circuits may be active whenever the display is active, or a proximity switch can be sued to activate the touch screen circuits only when the front surface of the display is touched.

The solar panel may also be used for imaging, as well as a touch screen. An algorithm may be used to capture multiple images, using different pixels of the display to provide different levels of brightness for compressive sensing.

Figure 10:
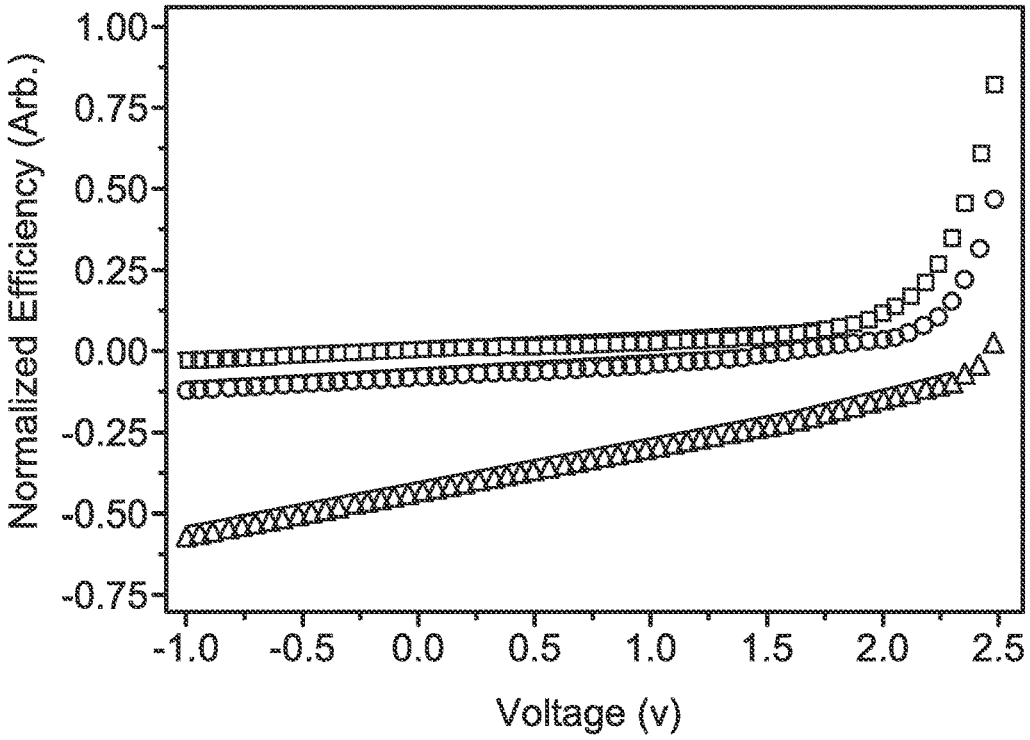
FIG. 10 is a plot of current efficiency vs. voltage for the integrated device of FIG. 6 with the solar cell in a dark environment, under illumination of the OLED layer with and without touch.

FIG. 10 is a plot of normalized current $I_{sc}$ vs. voltage $V_{oc}$ characteristics of the solar panel under the illumination of the overlying OLED layer, with and without touch. When the front of the integrated device is touched, $I_{sc}$ and $V_{oc}$ of the solar cell change from −0.16 μA to −0.87 μA and 1.6 V to 2.46 V, respectively, which allows the system to detect the touch. Since this technology is based on the contrast between the illuminating background and the light reflected by a fingertip, for example, the ambient light has an influence on the touch sensitivity of the system. The changes in $I_{sc}$ or $V_{oc}$ in FIG. 10 are relatively small, but by improving the solar cell efficiency and controlling the amount of background luminance by changing the thickness of the semitransparent cathode of the OLED, the contrast can be further improved. In general, a thinner semitransparent OLED cathode will benefit the luminance efficiency and lower the ambient light reflectance; however, it has a negative influence on the contrast of the touch screen.

In a modified embodiment, the solar panel is calibrated with different OLED and/or ambient brightness levels, and the values are stored in a lookup table (LUT). Touching the surface of the display changes the optical behavior of the stacked structure, and an expected value for each cell can be fetched from the LUT based on the OLED luminance and the ambient light. The output voltage or current from the solar cells can then be read, and a profile created based on differences between expected values and measured values. A predefined library or dictionary can be used to translate the created profile to different gestures or touch functions.

In another modified embodiment, each solar cell unit represents a pixel or sub-pixel, and the solar cells are calibrated as smaller units (pixel resolution) with light sources at different colors. Each solar cell unit may represent a cluster of pixels or sub-pixels. The solar cells are calibrated as smaller units (pixel resolution) with reference light sources at different color and brightness levels, and the values stored in LUTs or used to make functions. The calibration measurements can be repeated during the display lifetime by the user or at defined intervals based on the usage of the display. Calibrating the input video signals with the values stored in the LUTs can compensate for non-uniformity and aging. Different gray scales may be applied while measuring the values of each solar cell unit, and storing the values in a LUT.

Each solar cell unit can represent a pixel or sub-pixel. The solar cell can be calibrated as smaller units (pixel resolution) with reference light sources at different colors and brightness levels and the values stored in LUTs or used to make functions. Different gray scales may be applied while measuring the values of each solar cell unit, and then calibrating the input video signals with the values stored in the LUTs to compensate for non-uniformity and aging. The calibration measurements can be repeated during the display lifetime by the user or at defined intervals based on the usage of the display.

Alternatively, each solar cell unit can represent a pixel or sub-pixel, calibrated as smaller units (pixel resolution) with reference light sources at different colors and brightness levels with the values being stored in LUTs or used to make functions, and then applying different patterns (e.g., created as described in U.S. Patent Application Publication No. 2011/0227964, which is incorporated by reference in its entirety herein) to each cluster and measuring the values of each solar cell unit. The functions and methods described in U.S. Patent Application Publication No. 2011/0227964 may be used to extract the non-uniformities/aging for each pixel in the clusters, with the resulting values being stored in a LUT. The input video signals may then be calibrated with the values stored in LUTs to compensate for non-uniformity and aging. The measurements can be repeated during the display lifetime either by the user or at defined intervals based on display usage.

Figure 11A:
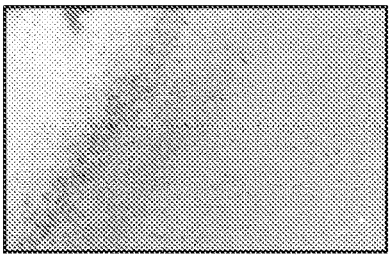
FIG. 11A is an image of an AMOLED panel without compensation.
Figure 11B:
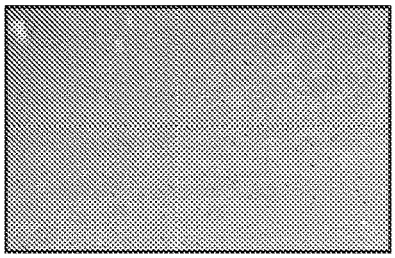
FIG. 11B is an image of an AMOLED panel with in-pixel compensation.
Figure 11C:
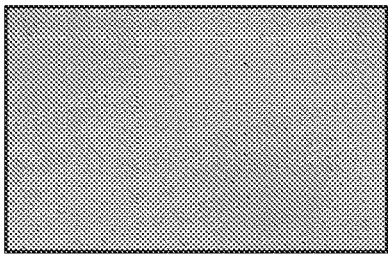
FIG. 11C is an image of an AMOLED panel with extra external calibration.

The solar panel can also be used for initial uniformity calibration of the display. One of the major problems with OLED panels is non-uniformity. Common sources of non-uniformity are the manufacturing process and differential aging during use. While in-pixel compensation can improve the uniformity of a display, the limited compensation level attainable with this technique is not sufficient for some displays, thereby reducing the yield. With the integrated OLED/solar panel, the output current of the solar panel can be used to detect and correct non-uniformities in the display. Specifically, calibrated imaging can be used to determine the luminance of each pixel at various levels. The theory has also been tested on an AMOLED display, and FIG. 11 shows uniformity images of an AMOLED panel (a) without compensation, (b) with in-pixel compensation and (c) with extra external compensation. FIG. 11(*c*) highlights the effect of external compensation which increases the yield to a significantly higher level (some ripples are due to the interference between camera and display spatial resolution). Here the solar panel was calibrated with an external source first and then the panel was calibrated with the results extracted from the panel.

As can be seen from the foregoing description, the integrated display can be used to provide AMOLED displays with a low ambient light reflectance without employing any extra layers (polarizer), low power consumption with recycled electrical energy, and functionality as an optical based touch screen without an extra touch panel, LED sources or sensors. Moreover, the output of the solar panel can be used to detect and correct the non-uniformity of the OLED panel. By carefully choosing the solar cell and adjusting the semitransparent cathode of the OLED, the performance of this display system can be greatly improved.

Arrayed solid state devices, such as active matrix organic light emitting (AMOLED) displays, are prone to structural and/or random non-uniformity. The structural non-uniformity can be caused by several different sources such as driving components, fabrication procedure, mechanical structure, and more. For example, the routing of signals through the panel may cause different delays and resistive drop. Therefore, it can cause a non-uniformity pattern.

In one example of driver-induced structural non-uniformity, when the select (address lines) are generated by a central source at the edge of the panel and distributed to different columns or rows can experience different delays. Although some can match the delay by adjusting the trace widths by different patterning, the accuracy is limited due to the limited area available for routing.

In another example of driver-induced structural non-uniformity, the measurement units used to extract the pixel non-uniformity will not match accurately. Therefore the measured data can have an offset (or gain) variation across the measurement units In an example of fabrication-induced structural non-uniformity, the patterning can cause a repeated pattern (especially if step-and-repeat is used. Here a smaller mask is used but it is moved across the substrate to pattern the entire area that has the same pattern).

In another example of fabrication-induced structural non-uniformity, the material development process such as laser annealing can create repeated pattern in orientation of the process.

An example of mechanical structural non-uniformity is the effect of mechanical stress caused by the conformal structure of the device.

Also, the random non-uniformity can consist of low frequency and high frequency patterns. Here, the low frequency patterns are considered as global non-uniformities and the high-frequency patterns are called local non-uniformity.

Invention Overview

Array structure solid state devices such as active matrix OLED (AMOLED) displays are prone to structural non-uniformity caused by drivers, fabrication process, and/or physical conditions. An example for driver structural non-uniformity can be the mismatches between different drivers used in one array device (panel). These drivers could be providing signals to the panels or extracting signals from the panels to be used for compensation. For example, multiple measurement units are used in an AMOLED panel to extract the electrical non-uniformity of the panel. The data is then used to compensate the non-uniformity. The fabrication non-uniformity can be caused by process steps. In one case, the step-and-repeat process in patterning can result in structural non-uniformity across the panel. Also, mechanical stress as the result of packaging can result in structural non-uniformity.

In one embodiment, some images (e.g. flat-field or patterns based on structural non-uniformity) are displayed in the panel; image/optical sensors in association with a pattern matching the structural non-uniformity are used to extract the output of the patterns across the panel for each area of the structural non-uniformity. For example, if the non-uniformities are vertical bands caused by the drivers (or measurement units), a value for each band is extracted. These values are used to quantify the non-uniformities and compensate for them by modifying the input signals.

In another aspect of the invention, some images (e.g. flat-field or patterns based on structural non-uniformity) are displayed on the panel; and image/optical sensors in association with a pattern matching the structural non-uniformity are used to extract the output of the patterns across the panel for each area of the structural non-uniformity. For example, if the non-uniformities are vertical bands caused by the drivers (or measurement units), a value for each band is extracted. These values are used to quantify the non-uniformities and compensate for them at several response points by modifying the input signals. Then use those response points to interpolate (or curve fit) the entire response curve of the pixels. Then the response curve is used to create a compensated image for each input signals.

In another aspect of the invention, one can insert black values (or different values) for some of the areas in the structural pattern to eliminate the optical cross talks.

For example, if the panel has vertical bands, one can replace the odds bands with black and the other one with a desired value. In this case, the effect of cross talk is reduced significantly.

In another example, in case of the structural non-uniformity that is in the shape of 2D (two dimensional) patterns, the checker board approach can be used. Or one area is programmed with the desired value and all the surrounding areas are programmed with different values (e.g., black).

This can be done for any pattern; more than two different values can be used for differentiating the areas in the pattern.

For example, if the patterns are too small (e.g., the vertical or horizontal bands are very narrow or the checker board boxes are very narrow) more than one adjacent area can be programmed with different values (e.g., black).

In another embodiment, low frequency non-uniformities across the panel are extracted by applying the patterns (flat field), images are taken of the panel; the image is corrected to eliminate the non-ideality such as field of view and other factors; and its area and resolution is adjusted to match the panel by creating values for each pixel in the display; and the value is used to compensate the low frequency non-uniformities across the panel.

Under ideal conditions, after compensation (either in-pixel or external compensation) the uniformity should be within expected specifications.

For external compensation, each measurement attained through system yields the voltage (or a current) required to produce a specified output current (or voltage) for each and every sub-pixel. Then these values are used to create a compensated value for the entire panel or for a point in the output response of the display. Thus, after applying the compensated values to create a flat-field, the display should produce a perfectly uniform response. In reality, however, several factors may contribute to a non-perfect response. For instance, a mismatch in calibration between measurement circuits may artificially induce parasitic vertical banding into each measurement. Alternatively, loading effects on the panel coupled with non-idealities in panel layout may introduce darker or brighter horizontal waves known as 'gate bands.' In general, these issues are easiest to solve through external, optical correction.

Two applications of optical correction are (1) structural non-uniformity correction and (2) global non-uniformity correction.

Structural Non-Uniformity Caused by Measurement Units

Here the process to fix the structural non-uniformity caused by measurement units is described, but it will be understood that the process can be modified to compensate the other structural non-uniformities.

After the panel is measured at a few different operating points, compensated patterns (e.g., flat-field images) are created based on the measurement.

The optical measurement equipment (e.g., camera) is tuned to the appropriate exposure for maximum variation detection. In the case of vertical (or horizontal) bands two templates can be used. The first template turns off the even bands and the second template turns off the odd band. In this way, regions can be easily detected and the average variation determined for each region. Once the photographs are taken, the average variation is calculated. As mentioned above, each measurement should have a uniform response. Thus, the goal is to apply the following inverse to the entire measurement:

$$M_{corr} = \left( \frac{1}{\left( \frac{L_M}{avg(L_M)} \right)} \right) * M_{raw}$$

where $M_{raw}$ is the raw measurement and $L_M$ is the optically measured luminance variation.

Figure 12:
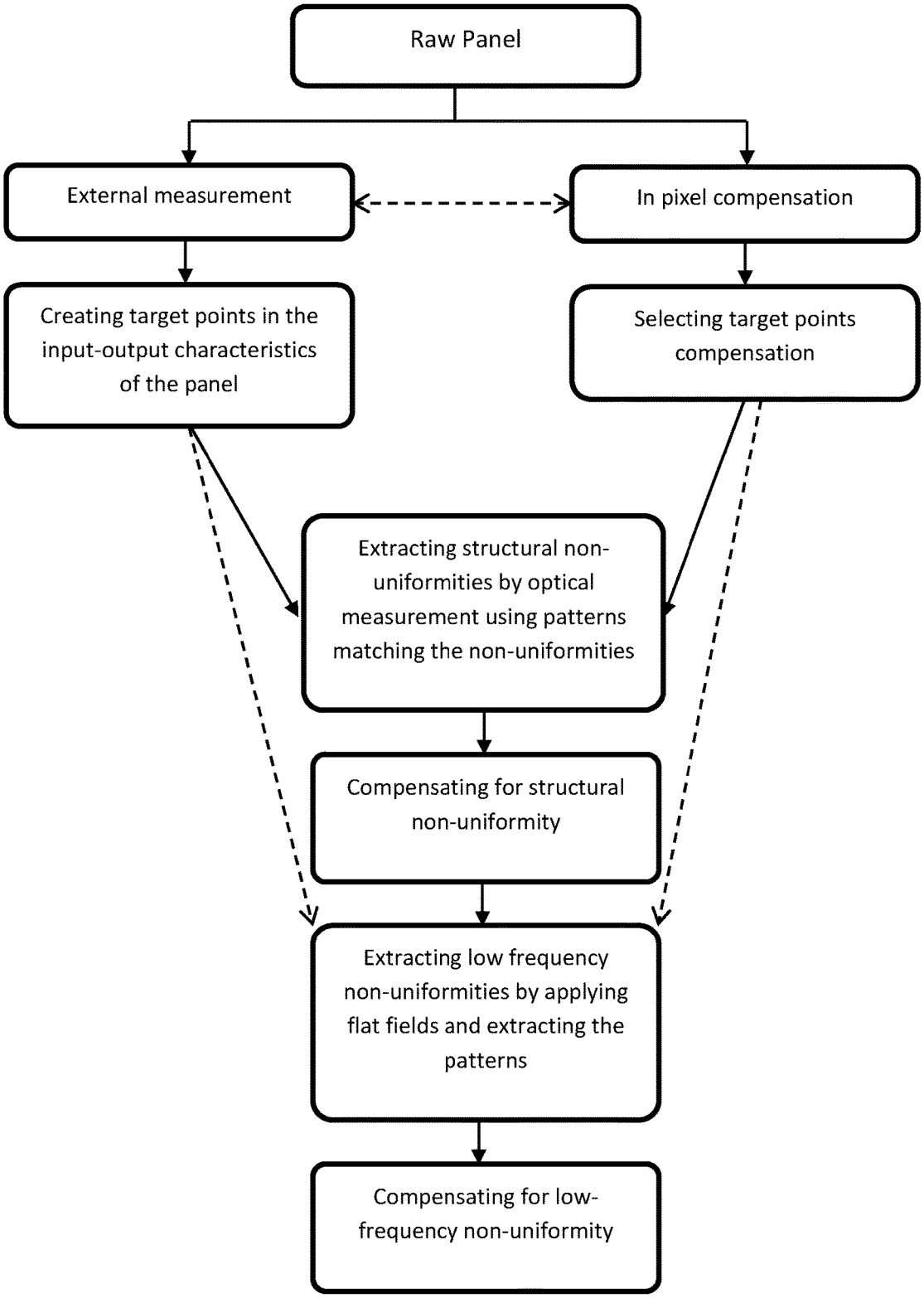
FIG. 12 is a flow chart of a structural and low-frequency compensation process.

FIG. 12 is a flow chart of a structural and low-frequency compensation process for a raw display panel. The external measurement path creates target points in the input-output characteristics of the panel. Then structural non-uniformities are extracted by optical measurement using patterns matching the non-uniformities. The measurements are used to compensate for the structural non-uniformities. Low-frequency non-uniformities are extracted by applying flat fields and extracting the patterns, which are used to compensate for the low-frequency non-uniformity. The in-pixel compensation path in FIG. 12 selects target points for compensation, and then follows the same steps described for the external measurement path.

The following is one example of a detailed procedure:

1. Setup the Optical Measurement Device (e.g., Camera)

Adjust the optical measurement device (OMD) to be as straight and level as possible. The internal level on the optical measurement device can be used in conjunction with a level held vertically against the front face of the lens. Fix the position of the OMD.

2. Setup the Panel

The panel should be centered in the frame of the camera. This can be done using guides such as the grid lines in the view finder if available. In one method, physical levels can be used to check that the panel is aligned. Also, a pre-adjusted gantry can be used for the panels. Here, as the panels arrive for measurement, they are aligned with the gantry. The gantry can have some physical marker that the panel can be rest against them or aligned with them. In addition, some alignment patterns shown in the display can be used to align the panel by moving or rotating based on the output of the OMD (which can be the same as the main OMD) and the alignment pattern. Moreover, the measurement image of the alignment patterns can be used to pre-process the actual measurement images taken by the OMD for non-uniformity correction.

3. Photograph the Template Images

Two template files are created, one of which blacks out all the even bands and the other all the odd bands. These are used to create template images for extracting the measurement structural non-uniformity data. These masks can be directly applied to the target compensated images created based on the externally measured data. The resulting files can now be displayed with only the selected sub-pixel (for example white) enabled. Since the bands in this case are all of equal width, the OMD settings should be adjusted such that the pixel width of bright areas is approximately equal to the pixel width of dark areas in the resulting images. One picture is needed of each of the template variations. The same OMD settings should be used for both.

4. Photograph the Curve Fit Points

While the correction data can be extracted directly from the above two images, in another embodiment of the invention implementation, an image of each of the target points in the output response of the display is taken. Here, the target points are compensated first based on the electrically measured data. The same OMD settings and adjustments described in step 2 are used. It was found experimentally that extracting the variance in white and applying it to all colors gave good final results while reducing the number of images and amount of data processing required. The position of the camera and the panel should remain fixed throughout steps 3 and 4.

5. Image Correction

In an effort to produce optimal correction, both the template images and curve-fit points should be corrected for artifacts introduced by the OMD. For instance, image distortion and chromatic aberration are corrected using parameters specified by the OMD and applied using standard methods. As a result, the images attained from the OMD can directly be matched to defects seen in electrically measured data for each curve-fit point.

For template images, boundaries at the edges of mask regions are first de-skewed and then further cropped using a threshold. As a result, each of the resulting edges is smooth, preventing adjacent details in the underlying image from leaking in. For instance, the underlying image to which the mask is being applied may have a bright region adjacent to a dark region. Rough edges on the applied mask may introduce inaccuracy in later stages as the bright region's OMD reading may leak into that of the dark region.

6. Find Image Co-Ordinates

Here, the alignment mark images can be used to identify the image coordinate in relation to display pixels. Since the alignments are shown in known display pixel index, the image can now be cropped to roughly the panel area. This reduces the amount of data processing required in subsequent steps.

7. Generate the Template Image Masks

In this case, the target point images are used to extract non-uniformities; and the two patterned images are used as mask. The rough crop from step 6 can be used to only process the portion of the template image that contains the panel. Where the brightness in those template images is higher than threshold, the pixel is set to 1 (or another value) and where the brightness is lower than threshold it is set to zero. In this case, the pattern images will turn to bands of black and white. These bands can be used to identify the boundaries of bands in the target point images.

8. Apply Generated Templates to Curve-Fit Points

Either using the patterned images or the target point images, a value is created for each band based on the OMD output using a data/image processing tool (e.g.: MATLAB). The measured luminance values for each region is corrected for outliers (typically $2\sigma$-$3\sigma$) and averaged.

9. Apply and Tune the Correction Factors

Using the overall panel average and the averages for each band, the created target points can be corrected by scaling each band by a fixed gain for each color and applying it to the original file. The gain required for each color of each level is determined by generating files with a range of gain factors, then displaying them on the panel.

In the case where the electrical measurement value is the grayscale required for each pixel to provide a fixed current, the target point is the measured data, although some correction may be applied to compensate for some of the non-idealities.

Low-Frequency Non-Uniformity Correction

Although low-frequency compensation can be applied to original target points or a raw panel, low-frequency uniformity compensation correction is generally applied once the other structural and high-frequency compensations procedure described above is completed for the panel. The following is one example of a detailed procedure:

1. Photograph the Structural Non-Uniformity Compensated Target Points

For each compensated target points, an image is captured for each of the sub-pixels (or combinations). For two target points, this will result in a total of 8 images. The exposure of OMD is then adjusted such that the histogram peak is approximately around 20%. This value can be different for different OMD devices and settings. To adjust, the target image is displayed with only the one sub-pixel enabled. The same settings are then used to image each of the remaining colors individually for a given level. However, one can use different setting for each sub-pixel.

2. Find the Corner Co-Ordinates

The same process as before can be applied to find the matching coordinate between images and display pixels using alignment marks. Also, if the display has not been moved, the same coordinates from previous setup can be used.

3. Correct the Image

Using the coordinates found in step 2, the image can be adjusted so that the resulting image matches the rectangular resolution of the display. In an effort to produce optimal correction, both the template images and curve-fit points should be corrected for artifacts introduced by the OMD. Image distortion and chromatic aberration are corrected using parameters specified by the OMD and applied using standard methods. If necessary a projective transform or other standard method can be used to square the image. Once square, the resolution can be scaled to match that of the panel. As a result, the images attained from the OMD can directly be matched to defects seen in electrically measured data for each curve-fit point.

4. Apply and Tune the Correction Factors

The images created from step 3 can be used to adjust the target points for global non-uniformity correction. Here, one method is to scale the extracted images and add them to the target points. In another method the extracted image can be scaled by a factor and then the target point images can be scaled by the modified images.

To extract the correction factors in any of the above methods, one can use sensors at few points in the panel and modified the factors till the variation in the reading of the sensors is within the specifications. In another method, one can use visual inspection to come up with correction factors. In both cases, the correction factor can be reused for other panels if the setup and the panel characteristics do not change.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A method of compensating for spatially repeated patterns of structural non-uniformities in an array of solid state devices in a display panel, said method comprising:

generating at least one image based on the spatially repeated patterns of the structural non-uniformities of the display panel, each of the at least one images matching one or more of the spatially repeated patterns;

displaying the at least one image in the panel;

extracting the outputs of the spatially repeated patterns across the panel, for each area of the structural non-uniformities;

quantifying the non-uniformities based on the values of the extracted outputs; and modifying input signals to the display panel to compensate for the non-uniformities.

2. The method of claim 1, in which said extracting is performed with use of the image sensors in spatial association with the spatially repeated patterns of the structural non-uniformities.

3. The method of claim 2, in which said image sensors are optical sensors.

4. The method of claim 1, in which said non-uniformities are modified at multiple response points by modifying said at least one image, and which includes using those response points to interpolate an entire response curve for the display panel, and using said response curve to create a compensated image.

5. The method of claim 1, in which black values are inserted for selected areas of said at least one image to reduce the effect of optical cross talk.

6. A method of compensating for non-uniformities in an array of solid state devices in a display panel, said method comprising:

extracting outputs of spatially repeated patterns of structural non-uniformities of the display panel with use of images based on the spatially repeated patterns; and compensating for the structural non-uniformities with use of values of said extracted outputs.

7. The method of claim 6, further comprising:

extracting low-frequency non-uniformities across the panel by applying patterns matching the low-frequency non-uniformities;

taking images of the pattern using an array of optical sensors;

adjusting the spatial area and spatial resolution of the image to match the panel by creating values for pixels in the display; and compensating low-frequency non-uniformities across the panel based on said created values.

8. A method of compensating for non-uniformities in an array of solid state devices in a display panel, said method comprising:

creating target points in the input-output characteristics of the panel;

extracting structural non-uniformities by optical measurement of images based on spatially repeated patterns of the structural non-uniformities of the display; and compensating for the structural non-uniformities.

9. The method of claim 8, in which extracting is performed with optical sensors in spatial association with spatial patterns matching the spatially repeated patterns of the structural non-uniformities.

10. The method of claim 8, further comprising:

extracting low-frequency non-uniformities by applying flat field and extracting the patterns matching the low-frequency non-uniformities, and compensating for the low-frequency non-uniformities.

* * * * *